US010113420B2

(12) United States Patent
Pogrebinsky et al.

(10) Patent No.: US 10,113,420 B2
(45) Date of Patent: Oct. 30, 2018

(54) ROTARY PULSERS AND ASSOCIATED METHODS

(71) Applicant: Geo Trend Corporation, Houston, TX (US)

(72) Inventors: Michael Simon Pogrebinsky, Houston, TX (US); Kirill Alekseyevich Trukhanov, Moscow Region (RU)

(73) Assignee: GEO TREND CORPORATION, Houston, TX (US)

( * ) Notice: Subject to any disclaimer, the term of this patent is extended or adjusted under 35 U.S.C. 154(b) by 187 days.

(21) Appl. No.: 14/851,222

(22) Filed: Sep. 11, 2015

(65) Prior Publication Data

US 2017/0074092 A1 Mar. 16, 2017

(51) Int. Cl.
*E21B 47/18* (2012.01)

(52) U.S. Cl.
CPC ..... *E21B 47/18* (2013.01)

(58) Field of Classification Search
CPC ..... E21B 47/18; E21B 47/182; E21B 47/185; E21B 47/187; E21B 7/062; E21B 7/068; E21B 17/1014; E21B 41/0085
See application file for complete search history.

(56) References Cited

U.S. PATENT DOCUMENTS

| | | | | |
|---|---|---|---|---|
| 4,493,189 | A | 1/1985 | Slater | |
| 5,073,877 | A | 12/1991 | Jeter | |
| 2002/0105858 | A1 | 8/2002 | Winnacker | |
| 2002/0112887 | A1* | 8/2002 | Harrison | E21B 7/04 175/27 |
| 2003/0105858 | A1 | 6/2003 | Hogg et al. | |
| 2004/0238222 | A1* | 12/2004 | Harrison | E21B 7/04 175/61 |
| 2005/0028522 | A1 | 2/2005 | Fripp et al. | |
| 2008/0002525 | A1* | 1/2008 | Pratt | E21B 47/18 367/84 |
| 2008/0060702 | A1 | 3/2008 | Muddiman | |
| 2009/0008151 | A1 | 1/2009 | Turner et al. | |
| 2009/0223359 | A1 | 9/2009 | Walker | |
| 2009/0285054 | A1* | 11/2009 | Song | E21B 47/182 367/84 |
| 2010/0157735 | A1* | 6/2010 | Allan | E21B 47/18 367/84 |
| 2015/0247403 | A1* | 9/2015 | Logan | E21B 47/18 175/40 |
| 2016/0130878 | A1* | 5/2016 | Cobern | E21B 7/04 175/25 |
| 2017/0074092 | A1* | 3/2017 | Pogrebinsky | E21B 47/18 |

FOREIGN PATENT DOCUMENTS

| | | |
|---|---|---|
| EP | 1056929 B1 | 7/2004 |
| WO PCT/US2015/049591 | | 9/2015 |

OTHER PUBLICATIONS

PCT International Search Report and Written Opinion for PCT/US2015/049591 dated Nov. 27, 2015.

* cited by examiner

*Primary Examiner* — An T Nguyen
(74) *Attorney, Agent, or Firm* — McCarter & English, LLP

(57) ABSTRACT

Exemplary embodiments of rotary pulsers are provided that include a stator and a rotor rotationally disposed adjacent to the stator. The rotary pulsers can include a regulator mechanism and a pump. Based on a parameter or condition associated with the rotary pulser, the regulator mechanism can adjust a parameter of the pump to control rotation of the rotor. Exemplary embodiments are also directed to methods of regulating a rotary pulser.

42 Claims, 32 Drawing Sheets

ROTARY PULSERS AND ASSOCIATED METHODS

TECHNICAL FIELD

The present invention generally relates to rotary pulsers including telemetry systems and associated methods and, in particular, to rotary pulsers including telemetry systems for adjustably controlling drilling operations with a rotary pulser.

BACKGROUND

Underground oil or gas drilling operations generally involve drilling a bore using a drill string. The drill string generally includes a drill bit connected to sections of long pipe which form the drill string and extend from the surface of the earth to the bottom of the bore. During the underground drilling operation, information about a position of sensors and the physical property of rocks is generally collected and transmitted to the surface for analysis and control of the drilling operation. A common transmission method used in the industry is based on generating pressure pulses by restricting drilling mud flow.

There are a number of tools which are used for pulse generation in drilling operations. One example is a tool having a rotary pulser construction. Rotary pulsers generally include a fixed stator with passages formed therein for allowing passage of drilling mud flow and a rotating rotor for closing and opening the passages of the stator to generate pressure pulses. With such rotary pulsers it can be difficult to obtain information regarding changes in the pressure of the drilling mud or of conditions in the bore, conditions which may require an adjustment of the generated pressure pulses. Therefore, higher maintenance issues and energy consumption can occur.

Traditional rotary pulsers generally include a motor for driving rotation of the rotor relative to the stator. The mechanical interaction between the motor, gears and/or shafts results in wear of the components over time and high energy consumption. Traditional rotary pulsers also generally do not have the ability to adjust the rotation of the rotor based on system parameters or conditions. Energy can be provided to the motor via a battery, which results in a limitation in the maximum rotational frequency of the rotor based on the power output from the battery. For example, some traditional rotary pulsers can be limited to approximately 4 Hz for rotation of the rotor. If high loads occur during the drilling process and there is a desire to work at a higher speed, a large current input is needed. The limit of current output of batteries (e.g., 5 A) limits the maximum speed of the rotor. Increasing the current output from a battery results in a faster uncharging time of the battery, thereby preventing the necessary work from being performed due to the constant replacement of the battery. The increased amount of uncharging and recharging of the battery can result in a decrease in functionality and effectiveness of the battery, creating further limits on the drilling process. Although generators can be used to power traditional rotary pulsers without incurring the uncharging/recharging issues, the traditional rotary pulsers still do not provide the ability to adjust the rotation of the rotor based on system parameters or conditions.

Signals produced by rotary pulsers can be divided into three types: positive pulse, negative pulse, and continuous wave. Positive pulses can be generated by brief partial or complete closure of the passages of the stator to prevent downward flow of the drilling mud. Negative pulses can be generated by short moments of bypass of the drilling mud through a valve passage. Continuous waves provide a continuous signal in time and amplitude. Continuous wave signals accurately reflect the shape of the wave that propagates in the drilling mud.

Creation of such signals can be performed by a rotary or linear type of mechanism. For example, the main shut-off or closure element for the drilling mud can be either a rotary drive (e.g., a closure element rotates to close the passages and prevent passage of drilling mud therethrough) or a linear translational drive (e.g., a closure element is moved linearly in a direction similar to that of flow of the drilling mud (or perpendicular to the flow of the drilling mud) to block the passage of drilling mud through an orifice).

An actuator can be used to drive the movement of the closure element. The actuator can be electric, hydraulic, mechanical, or a combination thereof. For example, an electric actuator can electrically drive the closure element, a hydraulic actuator can hydraulically drive the closure element, a mechanical actuator can mechanically drive the closure element, and a combination actuator can use two or more of the actuator types to drive the closure element.

Individually, each type of actuator has limitations and disadvantages for drilling operations. For example, as noted above, electric drive has limitations in the amount of power generated, e.g., the power per unit of volume of drive. Therefore, a combination of electric drive with mechanical gearing can be used. However, this combination has the limitations of low speed generation and high wear of the mechanical components. Hydraulic actuators generally require the use of vortex elements. In practice, a combination of electro-hydraulic drive provide a simpler assembly of components and a larger power density as compared to electromechanical drive. For example, the data transfer speed can be between approximately 3-5 bits/second. However, the limitations are caused by the use of the actuator to generate the desired pressure pulses in drilling mud.

Thus, a need exists for rotary pulsers including telemetry systems that adjustably control drilling operations to improve energy consumption and reduce maintenance issues. A need also exists for rotary pulsers including electrohydraulic actuator drives that create positive pulse signals and/or continuous wave signals. A need also exists for rotary pulsers that can be used to create pulse waves of almost any geometry or shape depending on the capabilities of the energy source. A need further exists for rotary pulsers that can be used to vary the form and type of information signal transmission which allows for an increase in the data transmission rate. These and other needs are addressed by the rotary pulsers and associated methods of the present disclosure.

SUMMARY

In accordance with embodiments of the present disclosure, exemplary modular rotary pulsers are provided that include telemetry systems for reducing power consumption and increasing speed of operation by optimizing the adaptive or adjustable control of the electrical and mechanical components for generation of pressure pulses. The rotary pulsers include an electromechanical unit including an electronic motor control unit and a motor. A shaft can be connected to the shaft of a variable pump. The rotary pulsers can include a disc tilt control mechanism regulator supplying working fluid to an actuator mechanism through channels in a distribution unit. One channel can be under pressure and the other channel can be connected to a drain channel. A pressure channel can connect the pump and a valve in several variations described herein.

As an example, in the case of an axial piston hydraulic motor, the pressure channel can connect to the pump via a cylinder block. The cylinder block can include four channels formed therein and extending from the valve to four cavities formed by the cylinder block and the pistons mounted therein. The pistons can abut a cam. The cam can be shaped as two planes intersecting at an acute, specially selected angle (i.e., a specially profiled am surface).

In some embodiments, the pressure channel can connect to the pump via a distribution unit. The distribution unit can include a valve module, a filter module, and a distribution module. The valve module can include a housing within which one or more valves are arranged to ensure pressure equalization and/or compensation, and limit the maximum pressure in the low pressure channel of the pump and in the rotary pulser. The valves can further connect the pressure sensor to the discharge or drain channel of the rotary pulser. The distribution module includes a distribution of two fluid channels from a pump (e.g., discharge and suction) into four channels of the actuator mechanism. In an embodiment of a quadrant-type actuator mechanism, the actuator mechanism can include two discharge channels disposed axially, and two suction channels also disposed axially relative to the discharge lines.

In some embodiments, the pressure channel can connect to the pump without the implementation of the distribution unit in the case of a reversible pump and motor. In some embodiments, a discharge channel can be connected at one end to the valve and connected at the other end to a suction channel of the pump. A valve shaft can be connected to the shaft of a stepper motor and can include a feedback device, e.g., a sensor, for detecting rotation of the valve shaft. The shaft can be rotatably fixed within the housing of the rotary pulser.

Actuation of the actuator mechanism can be performed in a variety of methods. In some embodiments, actuation of the actuator mechanism can be in the form of a part-turn axial piston motor that includes within the body a valve driven in rotation by a stepper motor. The stepper motor can include a shaft and a rotation angle sensor mounted on the shaft for sensing rotation of the motor. Feedback can thereby be provided for the position of the actuator shaft. In some embodiments, actuation of the actuator mechanism can be in the form of a quadrant that is a part-turn hydraulic motor with a limited angle of rotation for the shaft. The shaft can be fixedly attached to the motor such that the motor can rotate the shaft. If the actuator mechanism is in the form of a quadrant, in some embodiments, the rotary pulser may be formed without the distribution unit and the energy storage unit. A change in direction of rotation of the actuator shaft can be performed with the electric motor driven in reverse. If the actuator mechanism is in the form of a quadrant, in some embodiments, a rotation angle sensor for tracking the rotation of the actuator shaft can be used with a rotary variable differential transformer.

The energy storage unit can include a body divided by a piston into two cavities. One of the cavities can be connected to a discharge channel of the pump and can be filled with the working fluid at a high pressure. The second cavity can be connected to a suction channel of the pump. The second cavity can include a compressed, coiled spring. The spring can abut the housing on one side and the piston on the opposing side, thereby causing the piston to compress the working fluid in the cavity connected to the suction channel of the pump. The cavity filled with the pressurized working fluid can also be connected to a valve through the discharge channel. In some embodiments, the discharge channel can include a pressure sensor disposed therein.

In accordance with embodiments of the present disclosure, exemplary rotary pulsers are provided that include a stator and a rotor rotationally disposed adjacent to the stator. The rotary pulsers can include a regulator mechanism and a pump disposed within a housing. Based on a parameter or condition associated with the rotary pulser, the regulator mechanism can adjust (e.g., automatically adjust, or the like) a parameter of the pump to control rotation of the rotor. Adjusting the parameter of the pump to control rotation of the rotor can change a frequency, an amplitude, or both, of a pulse signal generated by the rotary pulser.

The regulator mechanism can include a motor mechanically coupled to one or more linkages. The one or more linkages can be mechanically coupled to a disc. Based on the parameter or condition associated with the rotary pulser, the regulator mechanism can adjust, control or regulate a tilt angle of the disc with the one or more linkages to adjust the parameter of the pump to control the rotation of the rotor.

The regulator mechanism can include a disc adapted to be tilted to vary a tilt angle of the disc. In some embodiments, the regulator mechanism can be in the form of a hydraulic regulator mechanism including a piston movably disposed within a hydraulic cylinder. Actuation or translation of the piston within the hydraulic cylinder can vary the tilt angle of the disc. In some embodiments, the regulator mechanism can be in the form of an electromechanical regulator mechanism including a motor and a plurality of linkages mechanically driven by the motor. The linkages can, in turn, vary the tilt angle of the disc. Varying the tilt angle of the disc adjusts the parameter of the pump to control the rotation of the rotor. The rotary pulsers can include two or more pistons secured at one end to a top surface of the disc and secured at an opposing end to the pump. In some embodiments, the pistons can be circumferentially secured to the top surface of the disc relative to a central axis of the disc. Varying the tilt angle of the disc actuates the pistons to adjust the parameter of the pump to control the rotation of the rotor. In some embodiments, the disc can include a substantially flat top surface and a substantially convex bottom surface. The disc can include a flange extending across the convex bottom surface. The flange can include a pair of hinges configured for coupling to one or more linkages of the regulator mechanism.

The rotary pulsers can include at least one sensor (e.g., a pressure sensor, an angle sensor, combinations thereof, or the like) for sensing the parameter or condition associated with the rotary pulsers and communicatively linked to the regulator mechanism. Based on a signal transmitted by the sensor to the regulator mechanism regarding a measured change in the parameter or condition associated with the rotary pulsers, the regulator mechanism can adjust the parameter of the pump to control rotation of the rotor.

The rotary pulsers can include an actuation mechanism disposed within the housing of the rotary pulser. The actuation mechanism can be directly or indirectly mechanically coupled to the regulator mechanism. The actuation mechanism can include a cylinder block, a valve disposed within the cylinder block, two or more pistons, and cams. Adjustment of the parameter of the pump with the regulator mechanism can automatically adjust rotation of the cylinder block which, in turn, adjusts the rotation of the rotor. The actuation mechanism can include a flow channel extending from the pump to the valve. The actuation mechanism can further include a first drain channel extending from the valve, through the cylinder block, and into a second drain channel formed in or passing through the rotary pulser. The cylinder block can include four channels radially formed in the cylinder block. The four channels can connect the valve to the pistons.

In some embodiments, the actuation mechanism can include a shaft mechanically coupled to the rotor and rotatably disposed within the actuation mechanism. The shaft includes rotary pistons (e.g., radial extensions, or the like) extending therefrom. The actuation mechanism can include a retainer mechanism for rotatably mounting the shaft within the actuation mechanism. The retainer mechanism can include bearings that form a self-centering mechanism for the shaft to ensure centered rotation of the shaft during operation. The retainer mechanism an include sectors disposed on opposing sides of a shaft housing. The sectors can limit the rotation of the shaft within the shaft housing of the actuation mechanism. In particular, the sectors can limit the rotation of the shaft to a predetermined range of angles.

In some embodiments, the cams of the actuation mechanism can define ramp profiles including rolling surfaces along which piston heads of the respective pistons move, roll or translate. The ramp profiles of the cams can impart varying degrees of forces on the piston heads as the pistons move along the rolling surfaces, thereby varying the actuation on the respective pistons.

The parameter or condition of the rotary pulser can be one or more of a variety of loads on the rotary pulser system. In some embodiments, the parameter or condition of the rotary pulser can be at least one of a load imparted on the rotor due to pressure of working fluid around the rotary pulser, a load imparted on the rotor due to pressure of working fluid within the rotary pulser, a fluid pressure in a drain or discharge channel of the rotary pulser, combinations thereof, or the like. The parameter of the pump can be a gear ratio of the pump. The pump can be mechanically connected or coupled to the regulator mechanism.

In some embodiments, the rotary pulser can include a distribution unit, an energy storage unit, a pump assembly including the pump and the regulator mechanism, and an electromechanical unit. In some embodiments, these units can be modular and independent relative to each other such that the units can be configured to be rearranged to design a variety of rotary pulser systems.

In accordance with embodiments of the present disclosure, exemplary methods of regulating a rotary pulser are provided. The methods include providing a rotary pulser. The rotary pulser can include a stator and a rotor rotationally disposed adjacent to the stator. The rotary pulsers can include a regulator mechanism and a pump. Based on a parameter or condition associated with the rotary pulser, the methods include adjusting a parameter of the pump with the regulator mechanism to control rotation of the rotor.

The methods can include sensing a change in the parameter or condition associated with the rotary pulser with a sensor communicatively linked to the regulator mechanism. The methods can include transmitting the sensed change in the parameter or condition to the regulator mechanism. The methods can include adjusting a rotation of a cylinder block of an actuation mechanism of the rotary pulser based on the adjusted parameter of the pump to control the rotation of the rotor.

In accordance with embodiments of the present disclosure, exemplary rotary pulsers are provided that include a stator, a rotor, a regulator mechanism, a pump and an actuation mechanism. The rotor can be rotationally disposed adjacent to the stator. The actuation mechanism can include cams and pistons. The rotor, the regulator mechanism, the pump and the actuation mechanism can be mechanically connected (directly or indirectly) relative to each other. The cams can define ramp profiles including rolling surfaces along which piston heads of the respective pistons move. The ramp profiles of the cams can impart varying degrees of forces on the piston heads as the pistons move along the rolling surfaces.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed rotary pulsers and associated methods, reference is made to the accompanying figures, wherein.

DESCRIPTION OF EXEMPLARY EMBODIMENTS

Figure 1:
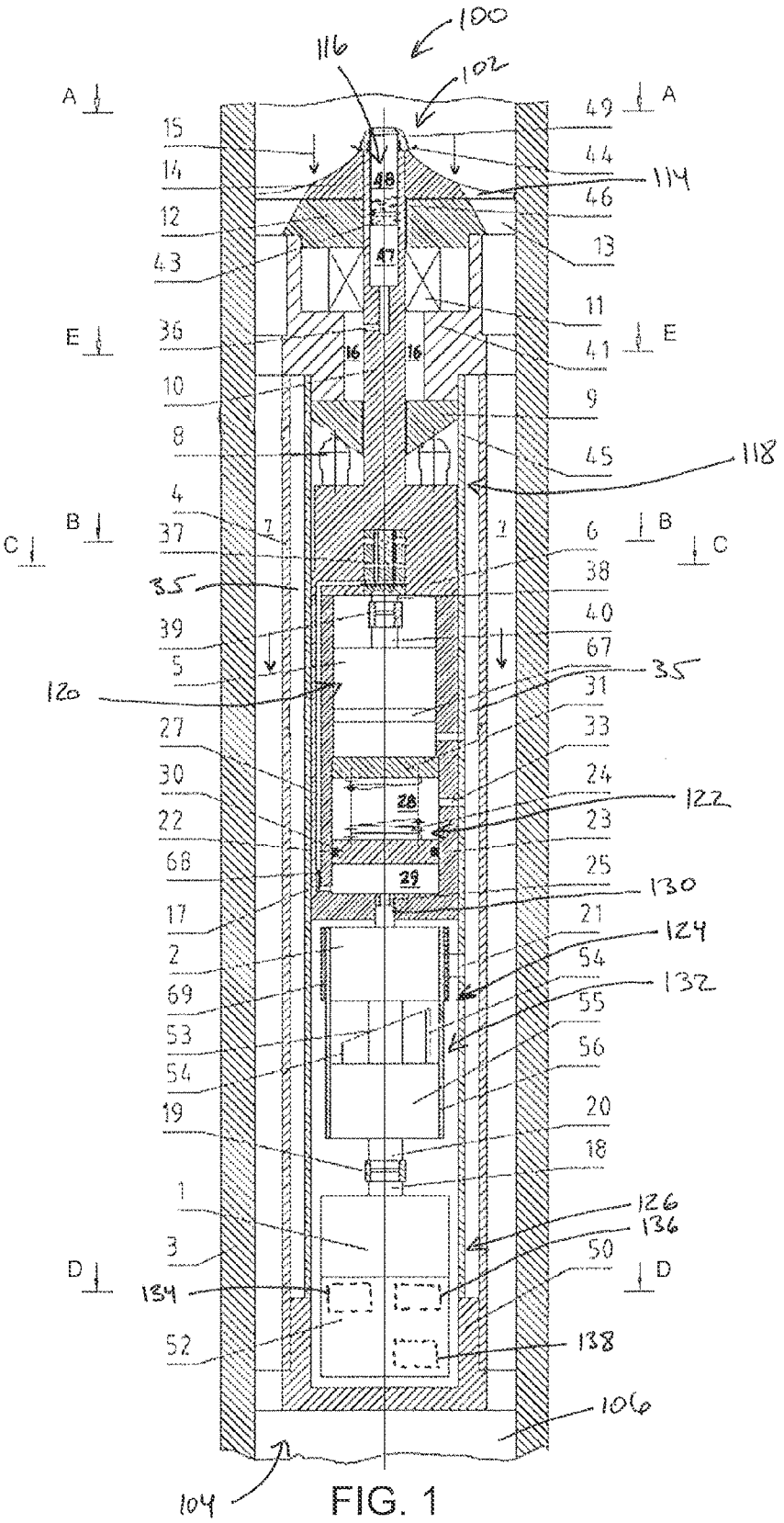
FIG. 1 is a side, cross-sectional view of an exemplary rotary pulser including a first embodiment of a telemetry system according to the present disclosure.

In accordance with embodiments of the present disclosure, exemplary modular rotary pulsers including telemetry systems are provided that allow for adjustable control of generated pressure pulses. In addition, the exemplary telemetry systems transmit signals to the surface of the earth from the depths of a drilling well in oil drilling operations with a rotary pulser. The exemplary telemetry systems reduce power consumption and increase speed of operation by optimizing the adaptive or adjustable control of the electrical and mechanical components for generation of pressure pulses. In particular, the exemplary telemetry systems optimize the signal for acceleration and deceleration of the shaft of the motors, e.g., the electric motor and/or the stepper motor, in the rotary pulser, thereby regulating the pump flow extending from the motor and the flow rate of the working fluid supplied from the valve located in a cylinder block to the pistons, resulting in rotation of the rotor to generate the optimal pressure pulses for drilling.

The exemplary devices described herein transmit telemetry data in a liquid medium by generating pressure pulses of varying shapes or forms, thereby transmitting data from an oil well to the surface during drilling operations. The signal transmitter is disposed in the channel through which drilling fluid flows. The rotary pulser generally includes a stator including at least one channel that allows the working fluid to flow from the region located above the stator to the region below the stator. The rotary pulser generally includes a rotor that is rotatably disposed in the housing. The rotor includes at least one blade capable of overlapping the channel in the stator to fully cover, throttle, or allow the working fluid to pass through the stator without throttling. Rotation of the rotor from the overlapping (e.g., closed) position to the open position and back at predetermined intervals of time generates a series of pressure pulses perceived by the telemetry system located on the surface of the earth.

In some embodiments, the rotary pulser includes a stepper motor disposed in the housing of the rotary pulser that actuates a hydraulic actuator. The hydraulic actuator includes a valve and a cylinder block, the cylinder block including a cam and pistons abutting the cam. The hydraulic actuator causes rotation of the rotor. The rotary pulser can include energy storage that includes two cavities separated by a piston. One of the cavities can be filled with fluid under high pressure and can be connected to a pump pressure line. The second cavity can be connected to the drain line and can be filled with a fluid to a pressure substantially equal to the pressure in the drilling fluid. The second cavity can include a spring abutting against one side of the energy storage enclosure or housing, and the other abutting the piston. The spring thereby forces the piston to compress the fluid when the cavity is filled under high pressure.

In some embodiments, the rotary pulser includes a quadrant-type actuator including a shaft that is rotated by introduction of fluid to a rotary piston that is fixed to the shaft of the actuator. In some embodiments, a variable pump can be used with two options for adjusting an angle of inclination of a disc, thereby changing the gear ratio of the hydraulic drive unit.

Turning to FIG. 1, a side, cross-sectional view of a first embodiment of an exemplary rotary pulser 100 is provided. The rotary pulser 100 can be positioned within a drilling bore 3, e.g., a well, extending from the surface of the earth to the bottom of the drilling bore 3. In particular, a proximal end 102 of the rotary pulser 100 can be positioned closer to the surface of the earth and the distal end 104 of the rotary pulser 100 can be positioned at the bottom of the drilling bore 3.

The rotary pulser 100 includes a housing 4, e.g., a cylindrical housing, surrounding the internal components of the rotary pulser 100. At or near the distal end 104, the rotary pulser 100 includes a drill head 106. When positioned within the drilling bore 3, the inner surface of the drilling bore 3 and the housing 4 of the rotary pulser 100 form a substantially annular or cylindrical channel 7 for passage of drilling fluid 15, e.g., drilling mud, or the like, from the surface of the earth to the drill head 106.

The rotary pulser 100 includes a cover 41, e.g., a cap, which can be secured to the housing 4 and the drilling bore 3 at a position offset from the proximal end 102 of the rotary pulser 100. The rotary pulser 100 further includes a cover 50, e.g., a cap, which can be secured to the housing 4 and the drilling bore 3 at a position near the distal end 104 of the rotary pulser 100, e.g., between the distal end 104 and the drill head 106. The covers 41, 50 can create a sealed environment or cavity within the housing 4 containing the internal components of the rotary pulser 100 disposed between the covers 41, 50. The cavity bound by the covers 41, 50 within the housing 4 can be filled with a working fluid, e.g., a hydraulic fluid, or the like. For example, prior to positioning the rotary pulser 100 within the drilling bore 3, the cavity between the covers 41, 50 and within the housing 4 can be filled with the working fluid up to a pressure substantially equal to the pressure at a depth of the drilling bore 3 (e.g., the depth at which drilling takes place).

Figure 2:
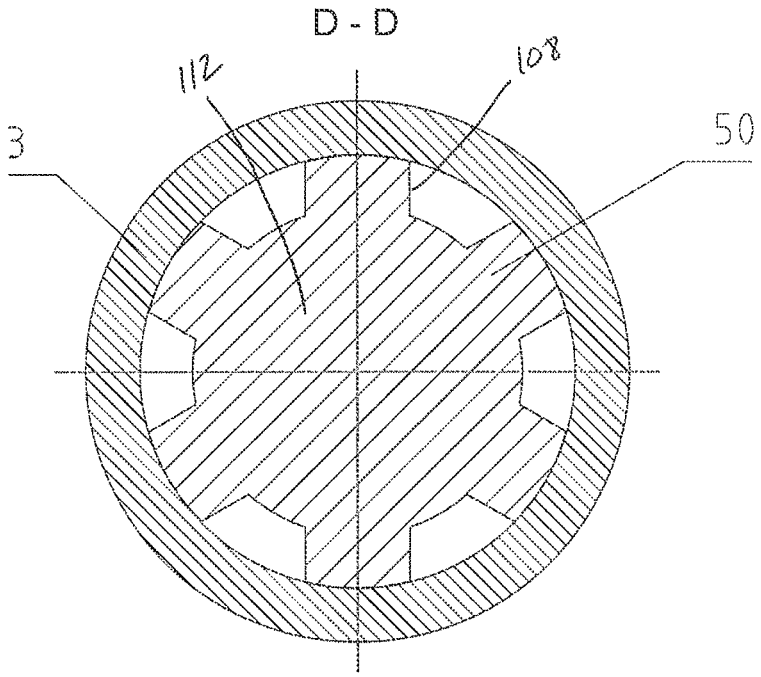
FIG. 2 is a cross-sectional view of an exemplary rotary pulser of FIG. 1 along section D-D.
Figure 3:
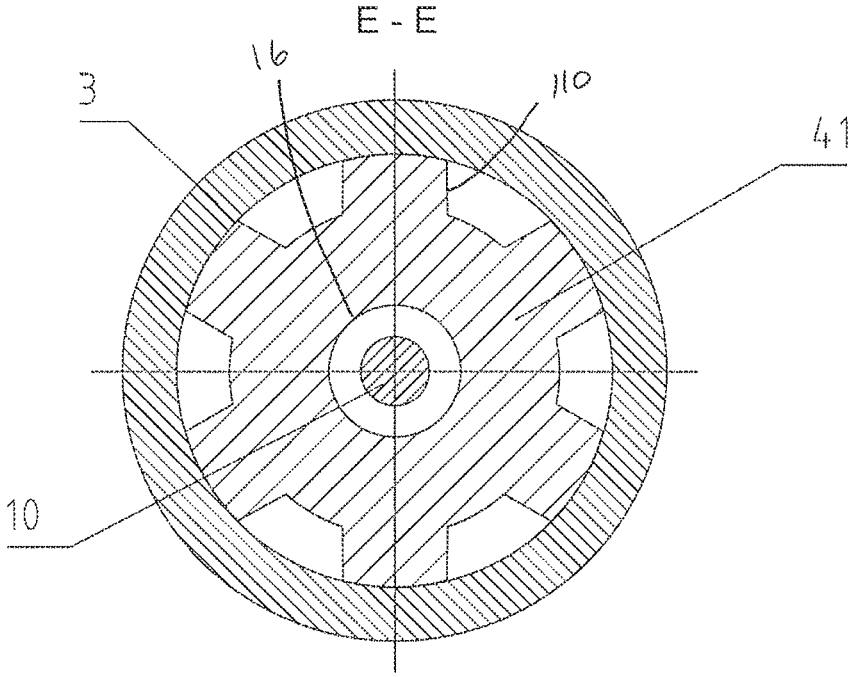
FIG. 3 is a cross-sectional view of an exemplary rotary pulser of FIG. 1 along section E-E.

By securing or positioning the covers 41, 50 within the drilling bore 3, the covers 41, 50 can define the bounds of the channel 7 between the rotary pulser 100 and the drilling bore 3. As shown in the cross-sectional views of FIGS. 2 and 3 of the rotary pulser 100 along sections D-D and E-E, respectively, the covers 41, 50 include openings 108, 110 which are configured and dimensioned to allow flow of the drilling fluid 15 to pass therethrough. In particular, the cover 41 includes a solid central portion 112 with the openings 108 circumferentially formed along the perimeter of the cover 41. The cover 50 includes a central opening 16 that permits passage of a shaft 10 therethrough and further includes the openings 110 circumferentially formed along the perimeter of the cover 50. Thus, the drilling fluid 15 can flow from the surface of the earth, through the openings 108 in the cover 41, through the channel 7, and through the openings 110 in the cover 50 to reach the bottom of the drilling bore 3.

The rotary pulser 100 includes a stator 12 disposed between the cover 41 and the proximal end 102. The stator 12 can be fixedly disposed relative to the housing 4 of the rotary pulser 100. The stator 12 includes one or more channels 13, e.g., openings, formed therethrough that are configured and dimensioned to allow flow of the drilling fluid 15 through the stator 12. The rotary pulser 100 includes a rotor 14 disposed between the stator 12 and the proximal end 102. The rotor 14 can be rotatably disposed relative to the housing 4 and the stator 12. The rotor 14 includes one or more rotor blades 114 circumferentially extending from a central portion of the rotor 14. The blades 114 can be configured and dimensioned to completely or partially overlap the channels 13 of the stator 12 depending on the angular position of the rotor 14 relative to the stator 12. Completely or partially overlapping the channels 13 with the blades 114, as well as completely opening the channels 13 to permit flow of drilling fluid 15 through the channels 13 creates a sequence of pressure pulses for electro-hydraulic operation and energy storage of the rotary pulser 100.

Figure 6:
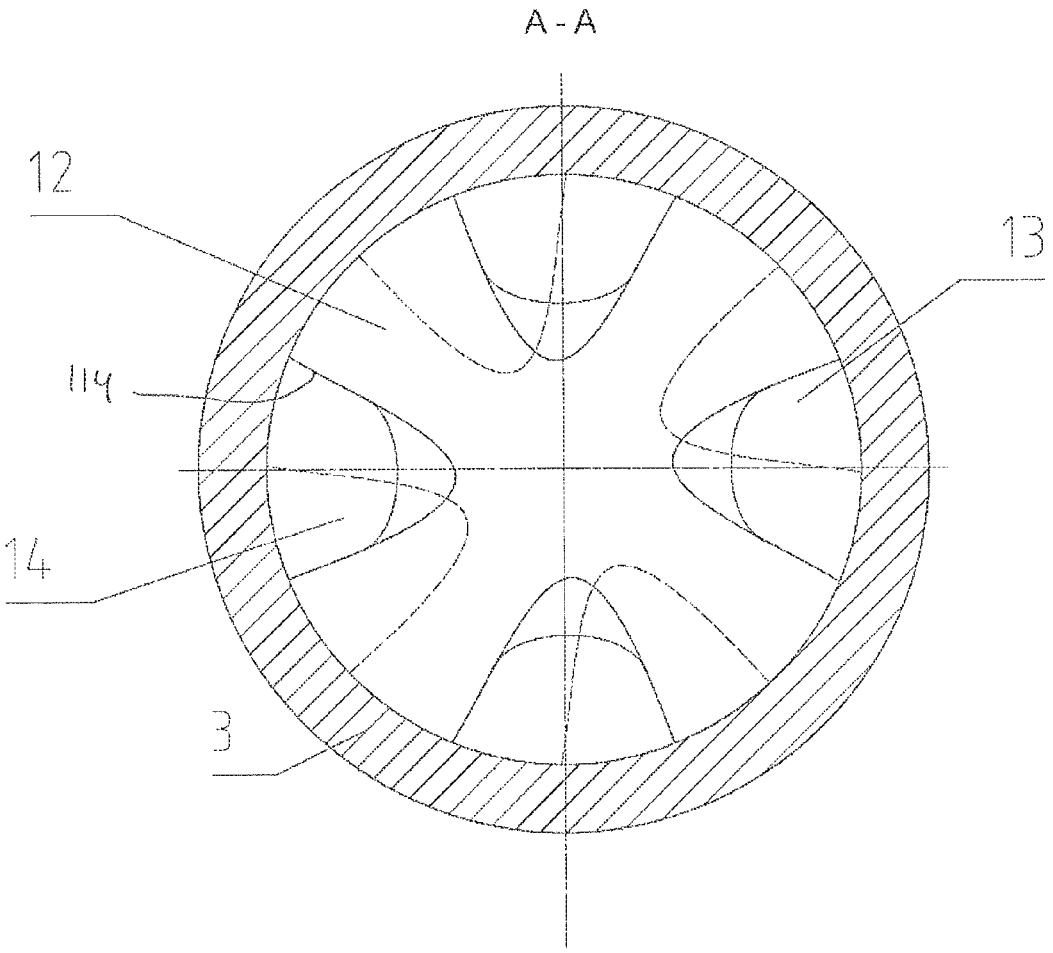
FIG. 6 is a cross-sectional view of an exemplary rotary pulser of FIG. 1 along section A-A.

FIG. 6 shows a cross-sectional view of the rotary pulser 100 along section A-A. In particular, FIG. 6 shows the relationship between the stator 12 and the rotor 14. With solid lines, the rotor 14 is shown in an initial position (e.g., a neutral position) with channels 13 of the stator 12 not covered by the blades 114, thereby allowing the drilling fluid 15 to freely flow through the drill bore 3. The dashed lines in FIG. 6 show the intermediate position of the rotor 14 when the rotor 14 is rotated relative to the neutral position to partially overlap the channels 13 of the stator 12. Although not illustrated, it should be understood that the rotor 14 can be rotated such that the blades 114 fully overlap the channels 13 of the stator 12, thereby closing the path of flow for the drilling fluid 15.

In situations where the rotary pulser 100 is shut down (e.g., during emergencies), the regulator mechanism of the rotary pulser 100 and/or the components associated with rotation of the rotor 14 can automatically position the rotor 14 such that the channels 13 of the stator 12 are not covered by the blades 114, thereby permitting the drilling fluid 15 to freely flow through the drill bore 3 (e.g., through the channel 7). This safety mechanism prevents a build-up of pressure in the rotary pulser 100 system. In some embodiments, the safety mechanism can be accomplished by the profile and shape of the channel 7 and/or the passages between the channels 13 of the rotor 14, such that a hydrodynamic force generated and imparted on the rotor 14 forces the rotor 14 to rotate and open the channels 13. Drilling fluid 15 can thereby freely flow through the channels 13.

Still with reference to FIG. 1, the rotary pulser 100 includes a shaft 10 fixedly connected to the rotor 14 and extending from the proximal end 102 of the housing 4 to a point beyond the cover 41. The shaft 10 can fixedly connect to (or be formed as one part with) a cylindrical block 6 disposed in an area of the housing between the covers 41, 50. The shaft 10 can be mounted in bearings 11 disposed between the stator and the cap 41. The shaft 10 can be rotated in a range of approximately ±25 degrees. The angular position of the shaft 10 can be limited by two sectors disposed within the housing 4 around the shaft 10 and located opposite each other (see, e.g., shaft 292 of FIG. 11). Clamps or retainers can secure the sectors against the housing 4 to prevent undesired movement of the sectors, resulting in a self-centering mechanism. Mounting of the shaft 10 in the bearings 11 allows for accurate fixation of a rotary piston in both the radial and axial directions and permits small clearances between the housing 4 and the rotary actuator (and other related mating components). The rotary piston can be disposed between the shaft 10 and the housing 4. Mounting of the shaft 10 in the bearing 11 also provides a minimum radial clearance of the actuator mechanism. The rotary piston can be mounted within the housing 4 with pins. As will be discussed in greater detail below, within the shaft 10 is embedded a pressure change compensation mechanism 116. A tip 49 can be disposed at the proximal end 102 of the rotary pulser 100 adjacent to the rotor 14. The tip 49 can be screwed onto the proximal end of the shaft 10. A lock nut 44 can be screwed near the tip 49 on the shaft 10 to prevent loosening of the tip 49 relative to the shaft 10.

The pressure change compensation mechanism 116 can include a housing divided into two cavities 47, 48. The cavities 47, 48 can be formed as bores in the shaft 10 extending from the proximal end in the direction of the distal end of the shaft 10. The mechanism 116 includes a spring 46, e.g., a compression spring, disposed within the cavity 48. The spring 46 can abut on one side against the inner surface of the tip 49 and can abut on the opposing side against a piston 43. In particular, the piston 43 can be disposed between the cavities 47, 48. In some embodiments, the spring 46 can be positioned at least partially within the piston 43.

The cavity 48 can be fluidically connected with the interior of the drill bore 3 and can be filled with the drilling fluid 15. The cavity 47 can be fluidically connected to a cavity formed by the opening 16 within the cover 41 via a channel 36. In particular, the channel 36 can extend from a distal end of the cavity 47, pass through the shaft 10, and connect to the opening 16 by a substantially ninety degree turn. The rotary pulser 100 can include a drain channel 35, e.g., a substantially cylindrical channel, formed between the housing 4, the internal components of the rotary pulser 100 housed within a cylindrical housing 45, and the covers 41, 50. The cavity formed by the opening 16 in the cover 41 can be fluidically connected to the drain channel 35. Thus, when changes in pressure of the drilling fluid 15 occur, due to the drilling fluid 15 disposed in the cavity 48 and the fluidic connection of the cavity 48 with the drilling bore 3, the piston 43 can be moved, thereby changing the volume of the cavity 47 in the mechanism 116.

Changing the volume of the cavity 47 changes the pressure in the drilling fluid 15 by enlarging the cavity 48 and permitting the pressure in the drilling fluid 15 to equalize. For example, an increase in the pressure of the drilling fluid 15 can force the piston 43 to move in a distal direction, e.g., towards the distal end 104 of the rotary pulser 100, thereby ejecting a portion of the drilling fluid 15 through the drain channel 35. As a further example, a decrease in the pressure of the drilling fluid 15 can force the piston 43 to move in a proximal direction, e.g., towards the proximal end 102 of the rotary pulser 100, thereby increasing the pressure in the drilling fluid 15. The mechanism 116 can thereby compensate for pressure variations in the drilling fluid 15 due to, e.g., conditions in the drilling bore 3, temperature changes of the drilling fluid 15 or in the drilling bore 3, and the like.

With reference to FIG. 1 and the cross-sectional views along sections C-C and B-B of FIGS. 4, and 5, the rotary pulser 100 further includes an actuation mechanism 118, a distribution unit 120, an energy storage unit 122, a pump assembly 124, and an electromechanical unit 126, each of which will be discussed in greater detail below. The actuation mechanism 118 includes the cylinder block 6 connected to the distal end of the shaft 10, e.g., the cylinder block 6 and the shaft 10 can be formed as a single structure. The cylinder block 6 includes a valve 37 disposed therein. The cylinder block 6 further includes one or more pistons 8 and cams 9 positioned between the cylinder block 6 and the cover 41. In some embodiments, the cylinder block 6 can include four pistons 8.

Figure 4:
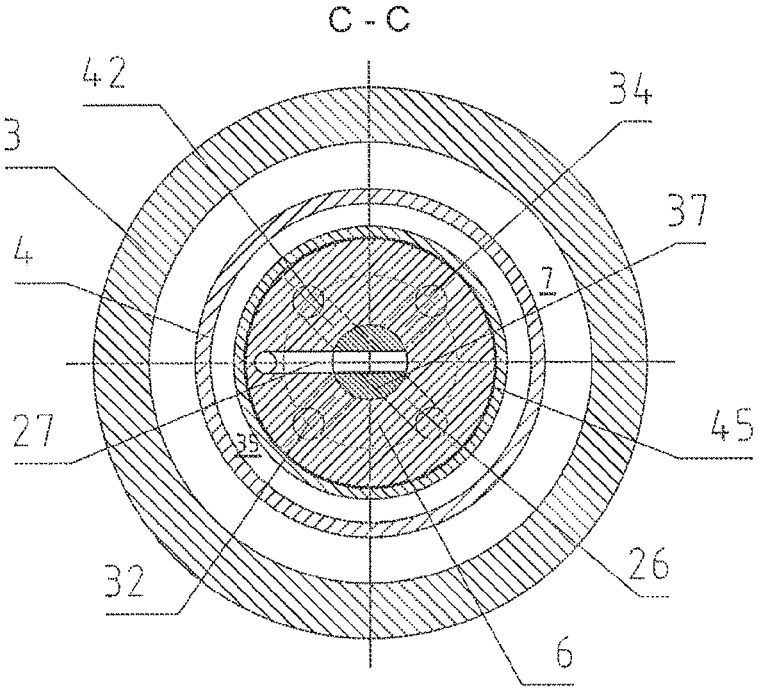
FIG. 4 is a cross-sectional view of an exemplary rotary pulser of FIG. 1 along section C-C.
Figure 5:
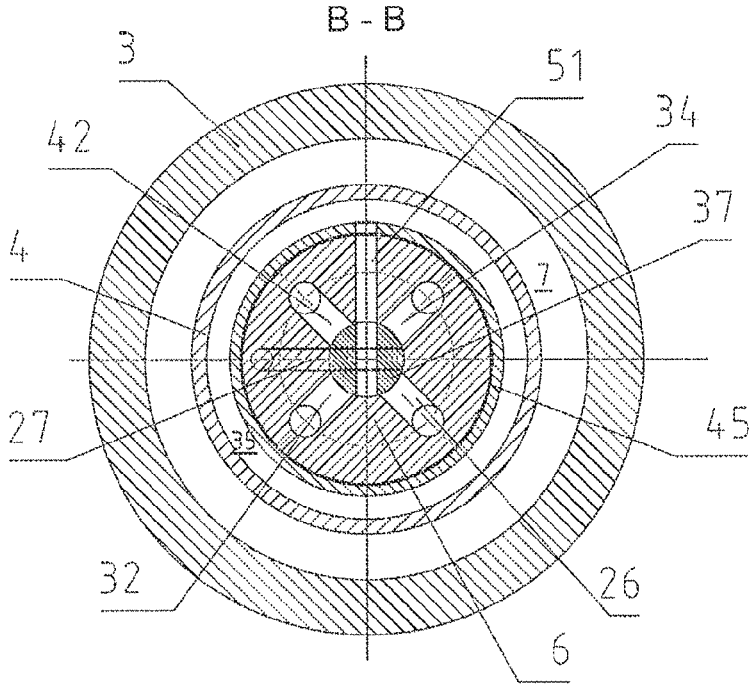
FIG. 5 is a cross-sectional view of an exemplary rotary pulser of FIG. 1 along section B-B.

With reference to FIGS. 1, 4 and 5, and the cross-sectional, left and ride side views of the valve 37 of FIGS. 16-21, the valve 37 includes a flow channel 27 extending therefrom, through the cylinder block 6, and around the distribution unit 120. The cylinder block 6 also includes a drain passage 51 fluidically connected on one end to the valve 37 and on the other end to the drain channel 35 formed by the housing 4 and the housing 45, e.g., tube or pipe (see, e.g., FIG. 5). The cylinder block 6 includes four channels 26, 32, 34, 42 (see, e.g., FIGS. 4 and 5). The channels 26, 32, 34, 42 radially extend from the valve 37 to four cavities formed by the cylinder block 6 and the pistons 8 mounted within the cylinder block 6.

The hydraulic drive of the rotary pulser 100 includes the interaction between the valve 37 in the cylinder block 6 and the fluid passing through the channels formed therein. In particular, the pressure or flow channel 27 extends from the pump 2 to the valve 37 in the cylinder block 6, the structure being rotatable via the motor 1. The drain channel 51 is connected at one end with the valve 37 and connected at the opposing end with the drain channel 35. The cylinder block 6 further includes the four channels 26, 32, 34, 42 which lead from the valve 37 to the four cavities formed by the cylinder block 6 and the pistons 8. The pistons 8, in turn, abut the cams 9 that define the form of two intersecting surfaces having sharp, specifically selected angles.

Figure 28:
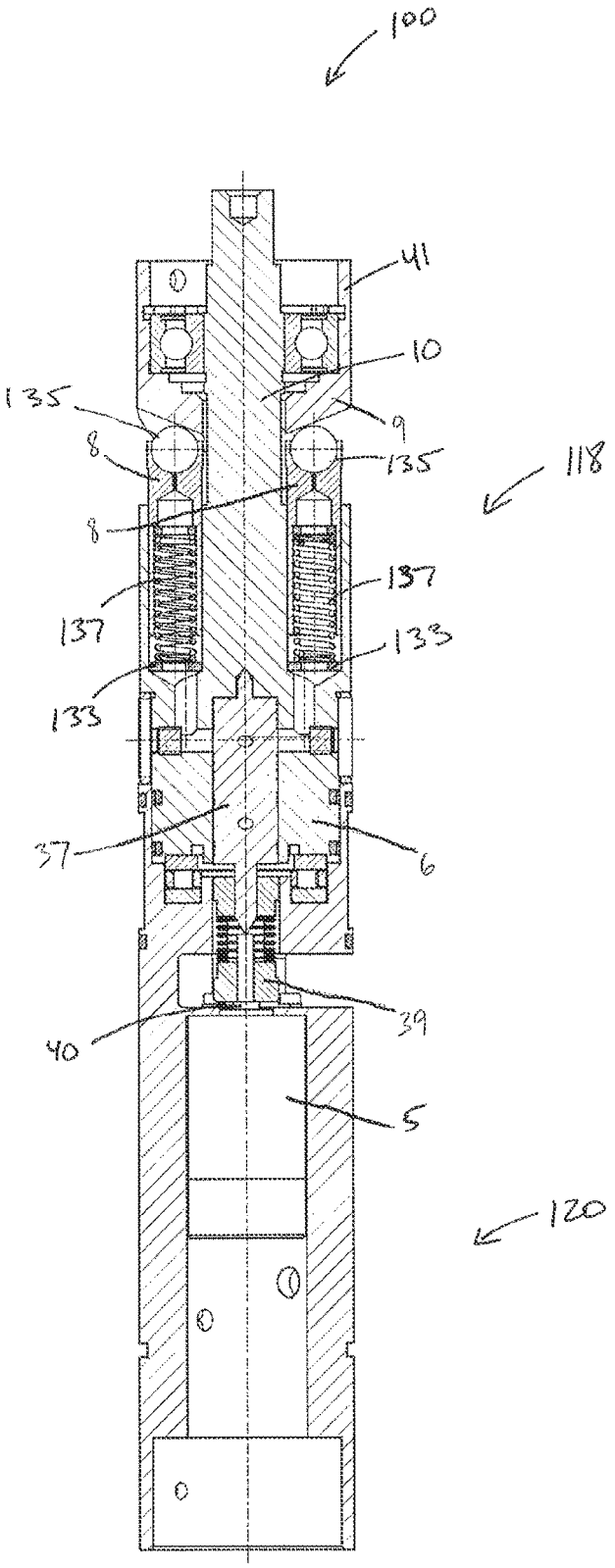
FIG. 28 a detailed, cross-sectional view of an actuation mechanism and distribution unit of an exemplary rotary pulser of FIG. 1.

With reference to FIGS. 1, 4, 5, 16-21 and 28-31, the pistons 8 can be configured to abut the cams 9 when extended from the piston cavity formed in the cylinder block 6. Each piston 8 can include a piston head 135 mechanically linked to a spring 137 (see, e.g., FIG. 28). One end of the springs 137 can be secured to a plate 133 located within the housing 4 of the rotary pulser 100 while the opposing end can be mechanically linked to the piston head 135. Thus, based on the position of the cams 9 and the force imparted on the respective pistons 8, the springs 137 can compress or expand to adjust the position of the piston head 135 and/or the plate 133. During operation, high pressure fluid from the flow channel 27 can pass through the valve 37 and against the plates 133 of the pistons 8. The force imparted on the plates 133 can be transferred through the springs 137 and the piston heads 135 against the cams 9. In particular, during operation, two pistons 8 can be mechanically and/or fluidically linked to the flow channel 27 and two pistons 8 can be mechanically and/or fluidically linked to the drain channel 35.

Figure 29:
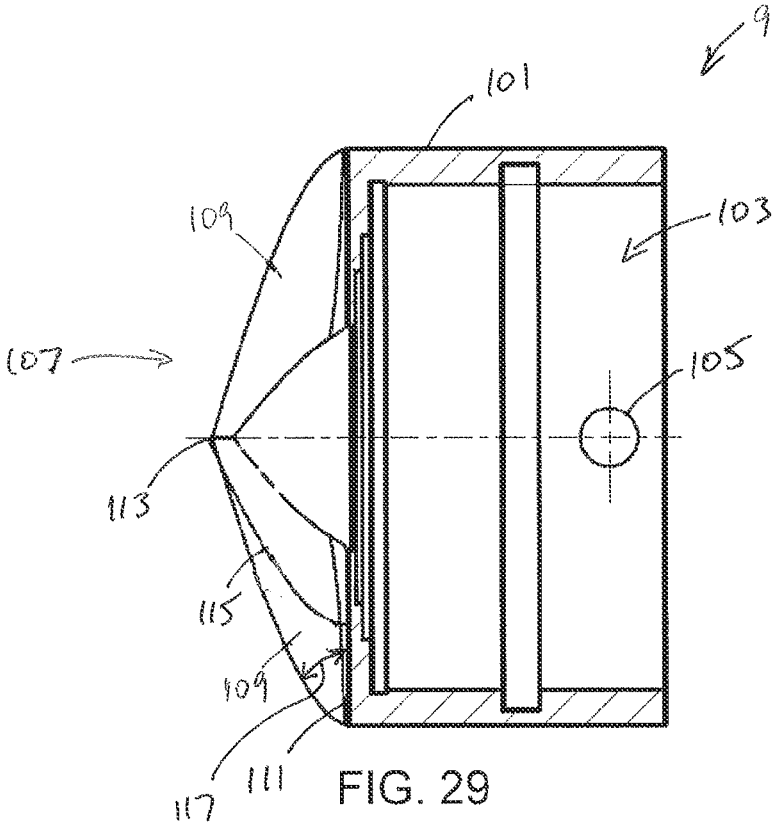
FIG. 29 is a cross-sectional view of a cam of an exemplary rotary pulser of FIG. 1 including a first working angle.
Figure 30:
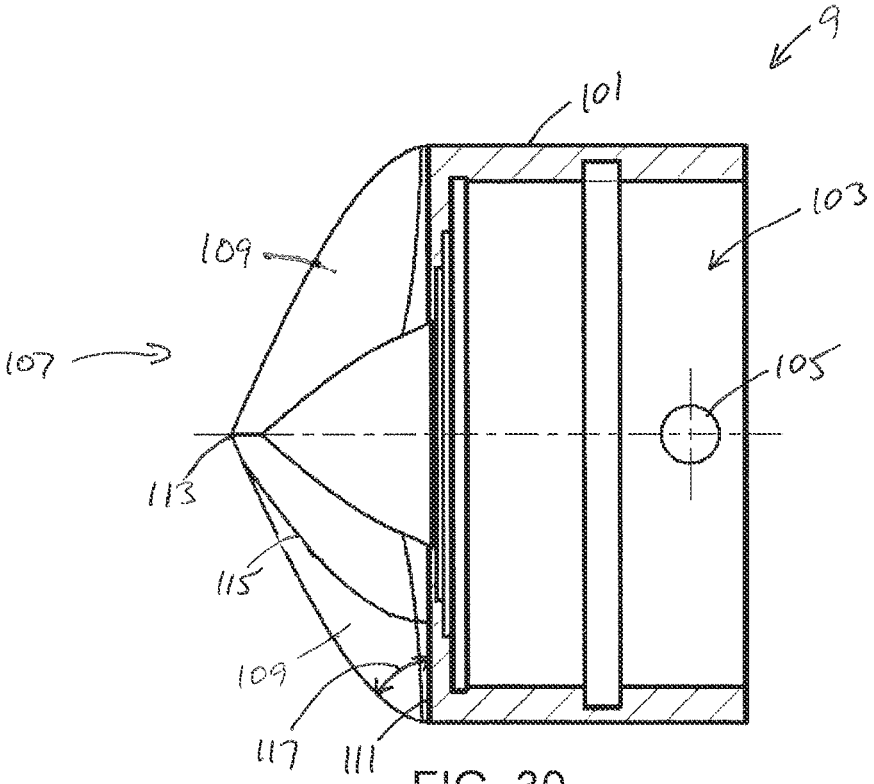
FIG. 30 is a cross-sectional view of a cam of an exemplary rotary pulser of FIG. 1 including a second working angle.
Figure 31:
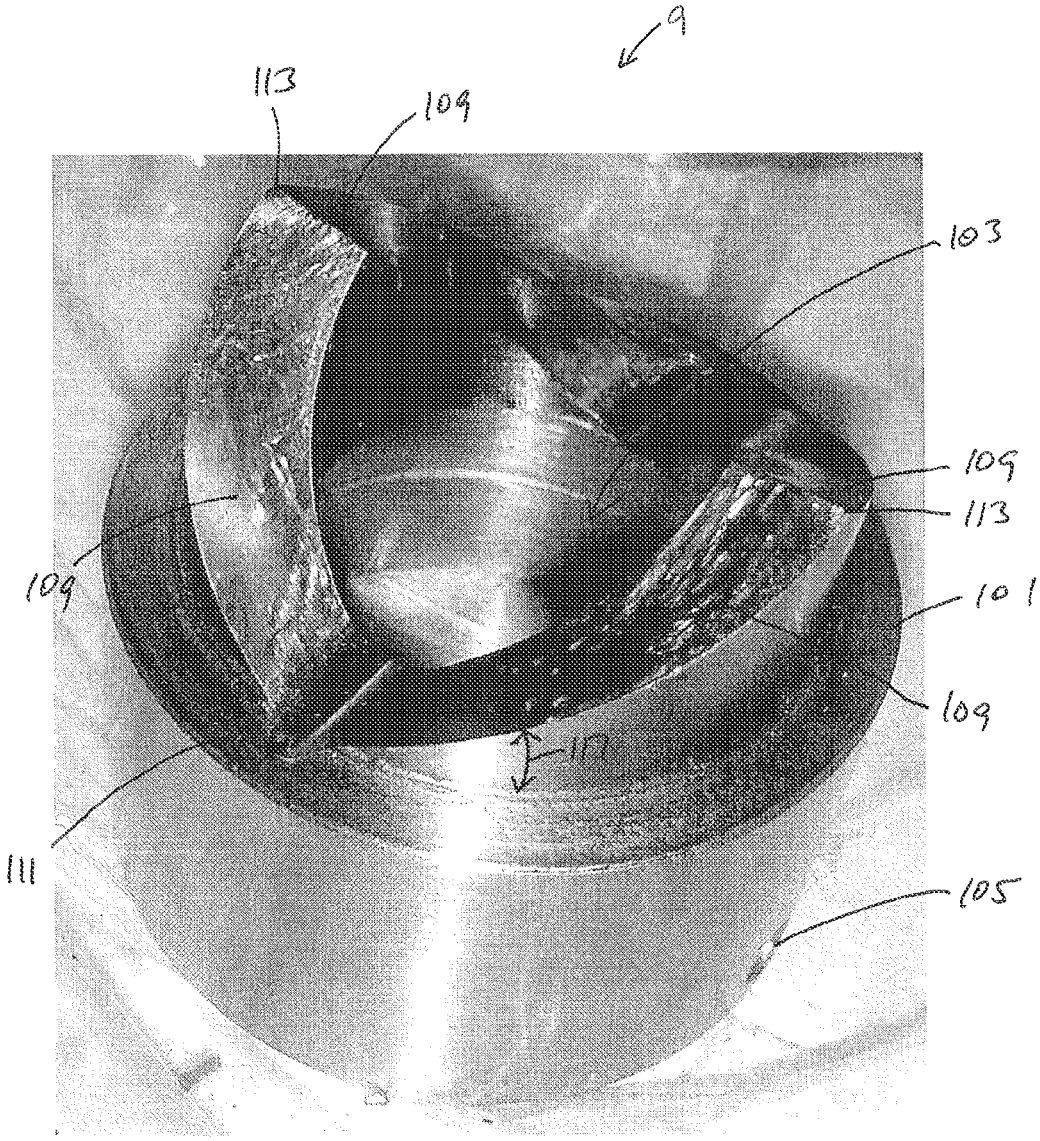
FIG. 31 is a perspective view of a cam of an exemplary rotary pulser of FIG. 1.

The cams 9 can define a shape of two intersecting planes at sharp angles, e.g., a specially profiled cam ramp. FIGS. 29-31 show cross-sectional views of exemplary embodiments of cams 9 having different profiles. The cam 9 includes a body 101 with a bore 103 passing therethrough. The bore 103 can be configured and dimensioned to receive a portion of the shaft 10. An internally threaded bore 105 with a set screw can be used to secure the cam 9 to the shaft 10 such that the cam 9 and shaft 10 simultaneously rotate. The cam 9 further includes an engagement section 107 for mechanically contacting and engaging with the piston heads 135 of the respective piston 137. The engagement section 107 can symmetrically include rolling surfaces 109 extending from a bottom edge 111 to a connecting point 113. In particular, as shown in the perspective view of FIG. 31, the cam 9 includes two pairs of rolling surfaces 109 that join at opposing connecting points 113.

The rolling surfaces 109 are angled relative to the bottom edge 111 such that the rolling surfaces 109 create a path 115 along which the piston head 135 can translate or roll and the different elevation or extension of the rolling surface 109 imparts varying forces on the piston head 135 (and vice versa). In particular, at the lowest point of the path 115 (e.g., the point at which the rolling surface 109 and the bottom edge 111 meet), the forces between the piston 8 and cam 9 can be minimal. At the highest point of the path 114 (e.g., at the connecting point 113), the forces between the piston 8 and the cam 9 can be the maximum.

As an example, FIG. 29 shows a cam 9 including rolling surfaces 109 that define a working or elevation angle 117 (e.g., an angle of ascent) profile of approximately 18 degrees. It should be understood that the elevation angle 117 can be measured with respect to the bottom edge 111 and the angle of inclination of the rolling surface 109. As a further example, FIGS. 30 and 31 show a cam 9 including rolling surfaces 109 that define a working or elevation elevation angle 117 profile of approximately 35 degrees. Those of ordinary skill in the art should understand that a variety of angles could be used.

Figure 32:
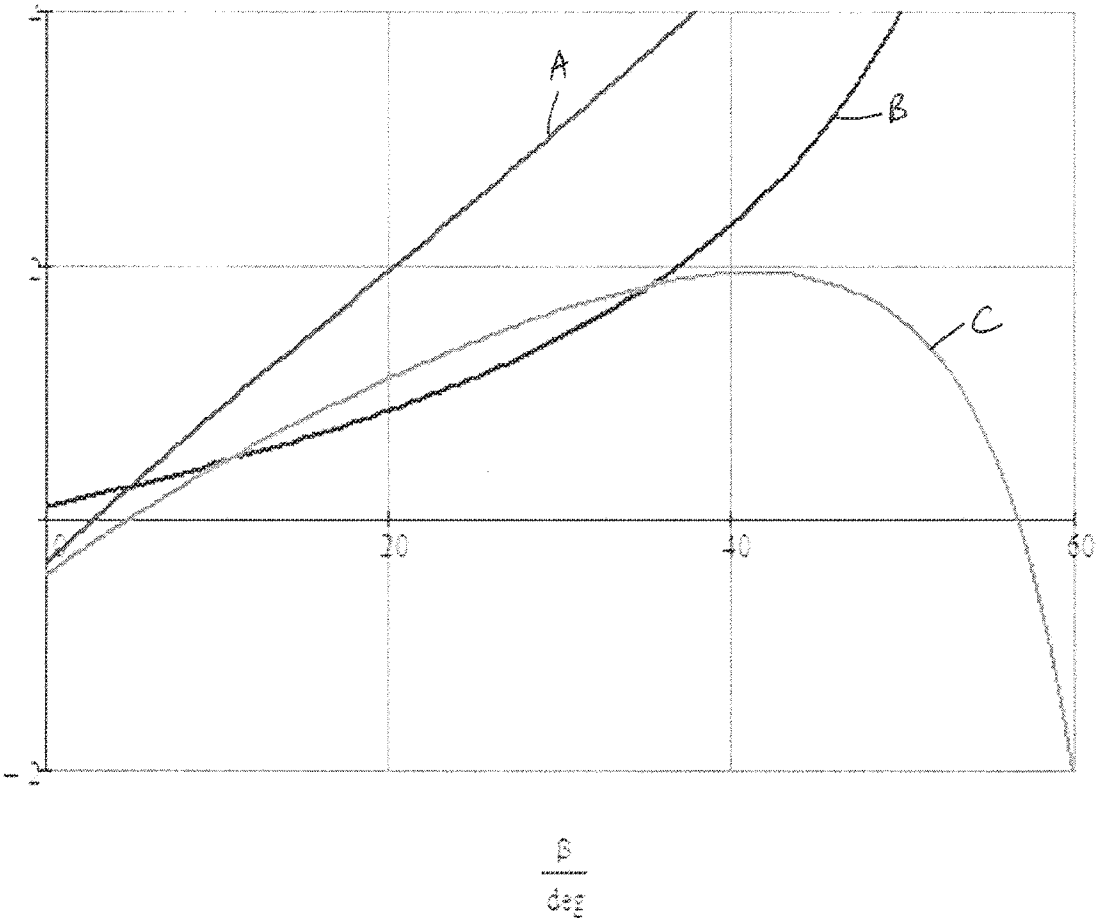
FIG. 32 is a graph illustrating torque values based on profile angles of a cam of an exemplary rotary pulser of FIG. 1.
Figure 33:
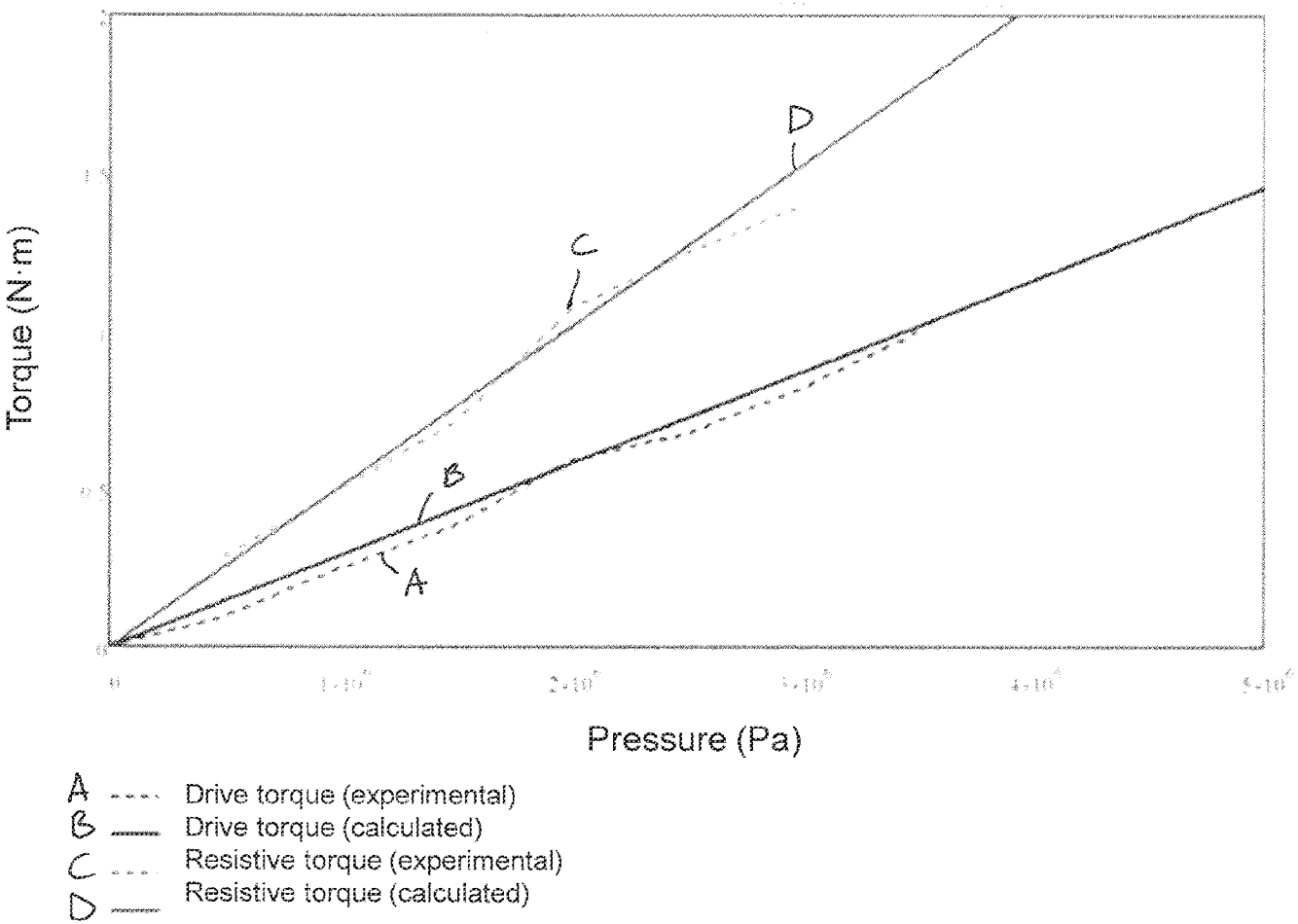
FIG. 33 is a graph illustrating experimental and calculated torque values for a cylinder block of an exemplary rotary pulser of FIG. 1.
Figure 34:
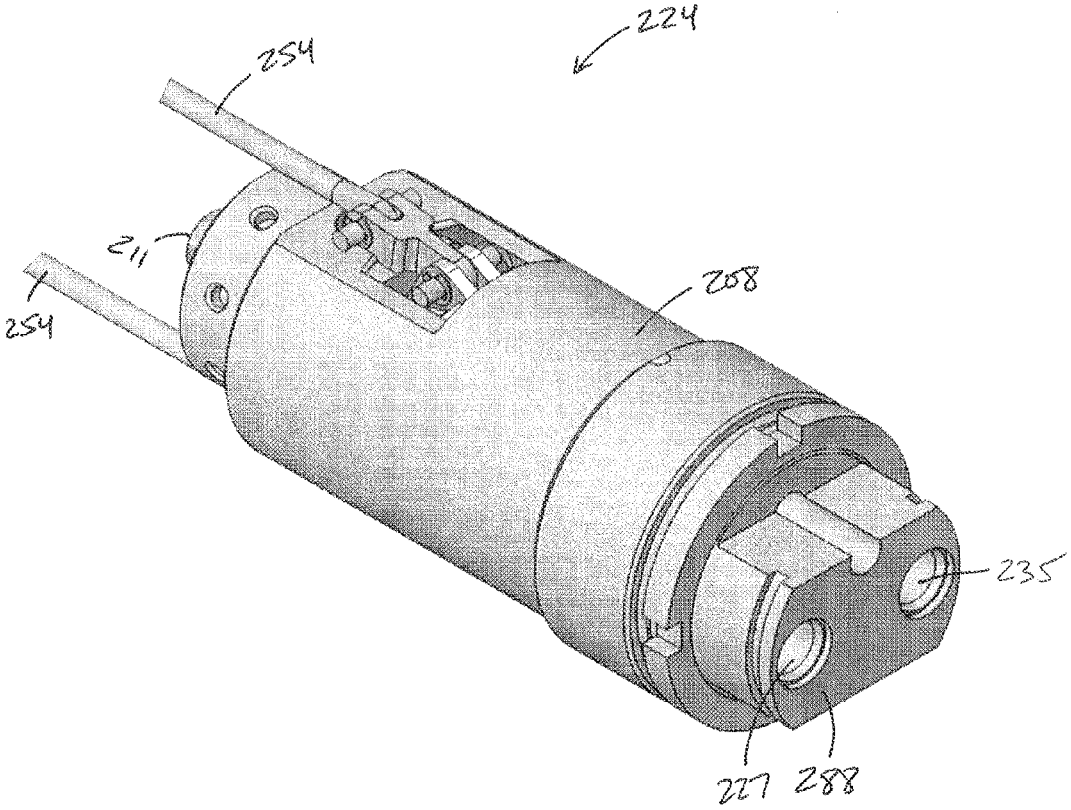
FIG. 34 is a perspective view of a pump assembly of an exemplary rotary pulser of FIG. 11 including a regulator mechanism for varying a tilt angle of a disc.
Figure 35:
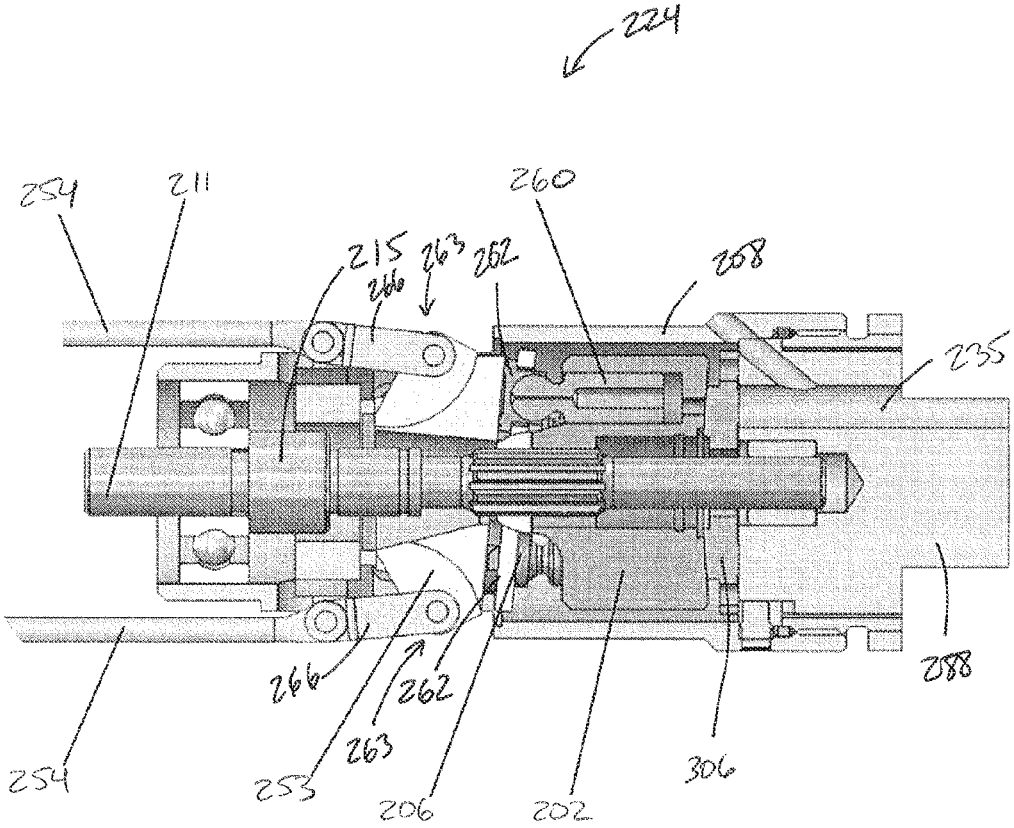
FIG. 35 is a cross-sectional view of a pump assembly of an exemplary rotary pulser of FIG. 11 including a regulator mechanism for varying a tilt angle of a disc.
Figure 36:
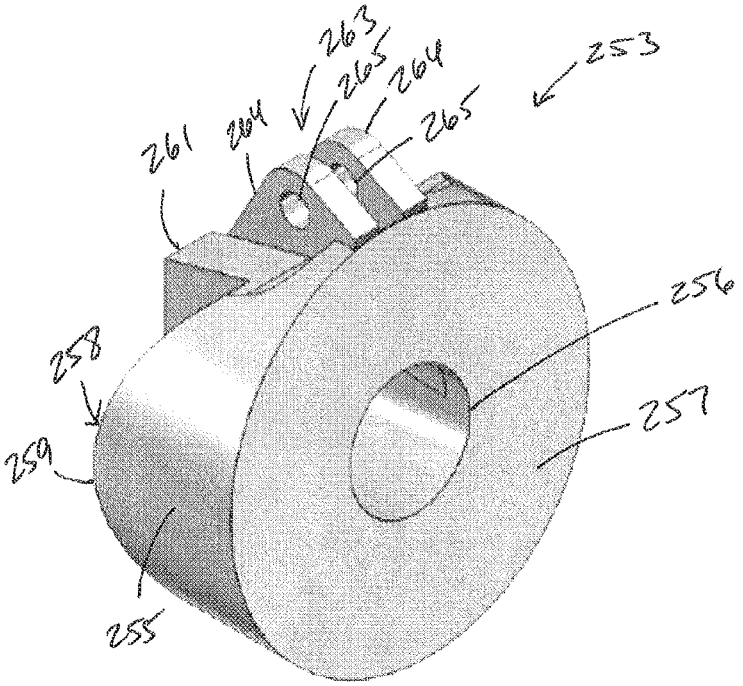
FIG. 36 is a perspective view of a disc of an exemplary rotary pulser of FIG. 11.
Figure 37:
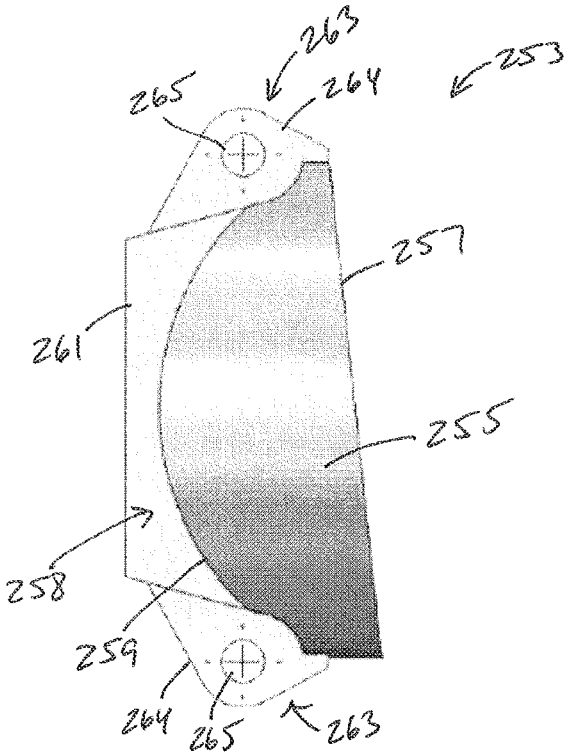
FIG. 37 is a side view of a disc of an exemplary rotary pulser of FIG. 11.
Figure 38:
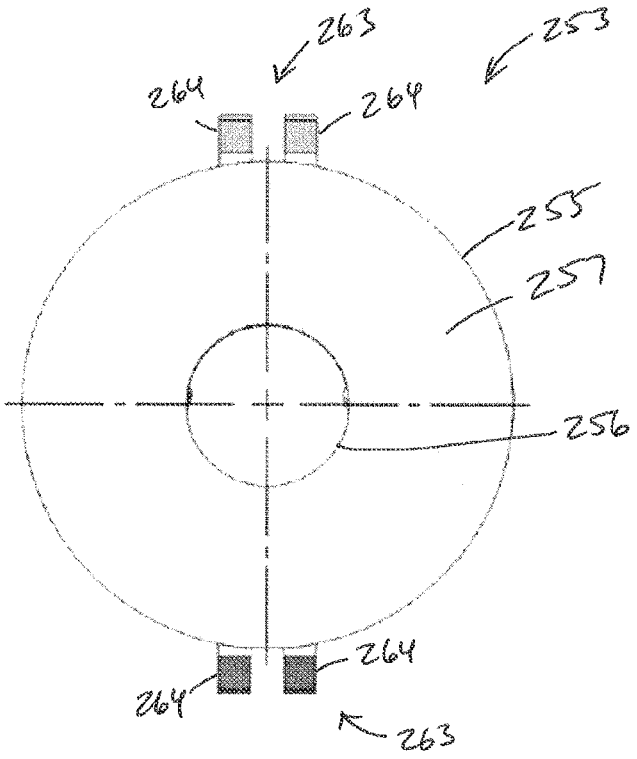
FIG. 38 is a top view of a disc of an exemplary rotary pulser of FIG. 11.
Figure 39:
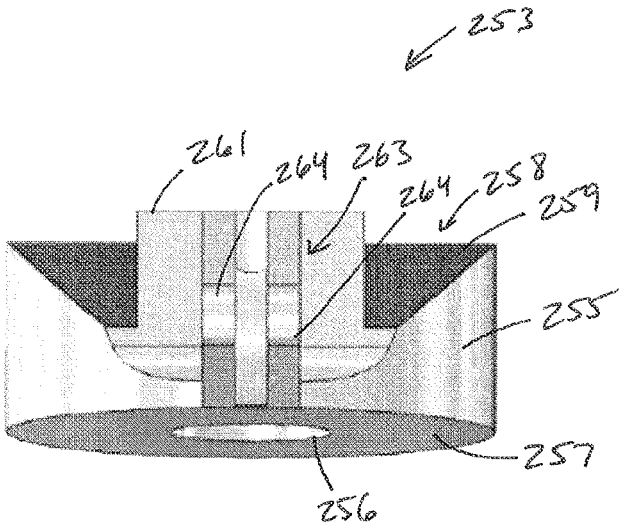
FIG. 39 is a side view of a disc of an exemplary rotary pulser of FIG. 11.

With reference to FIGS. 32 and 33, graphs showing torque or moment values for the cam 9 of the rotary pulser 100 are provided. In particular, FIG. 32 shows the varying torque values based on the elevation angle 117 of the rolling surfaces 109 of the cam 9, and FIG. 33 shows experimental and calculated values of torque for the cylinder block 6 based on interaction of the pistons 8 and cam 9. Curve A of FIG. 32 represents driving torque values for the cam 9, curve B represents resistive torque (e.g., friction moment) values for the cam 9, and curve C represents a difference in torque values between curves A and B for a supply pressure of approximately 60 bar, a drain pressure of approximately 15 bar, and an elevation angle 117 of the cam 9 from 0 to 60 degrees.

The driving torque or moment for the piston 8 based on the working pressure can be calculated by Equation 1, the resistive torque or moment for the piston 8 based on the working pressure can be calculated by Equation 2, the driving torque or moment for the piston 8 based on the drain or discharge channel pressure can be calculated by Equation 3, and the resistive torque or moment for the piston 8 based on the drain or discharge channel pressure can be calculated by Equation 4:

$$F_n(p_n, \alpha) = S \cdot \frac{pn}{\left[\begin{array}{c}\cos(\alpha) + K_{fbp} \cdot \sin(\alpha) + \\ K_{fbb} \cdot \left[(\sin(\alpha) - K_{fbp} \cdot \cos(\alpha)) \cdot \frac{(2 \cdot a + b)}{b}\right]\end{array}\right]} \quad (1)$$

$$M_d(p_n, \alpha) = r \cdot (F_n(p_n, \alpha) \cdot \sin(\alpha) - F_n(p_n, \alpha) \cdot K_{fbp} \cdot \cos(\alpha)) \quad (2)$$

$$F_c(p_c, \alpha) = S \cdot \frac{pc}{\left[\begin{array}{c}\cos(\alpha) + K_{fbp} \cdot \sin(\alpha) + \\ K_{fbb} \cdot \left[(\sin(\alpha) - K_{fbp} \cdot \cos(\alpha)) \cdot \frac{(2 \cdot a + b)}{b}\right]\end{array}\right]} \quad (3)$$

$$M_c(p_c, \alpha) = r \cdot (F_c(p_c, \alpha) \cdot \sin(\alpha) - F_c(p_c, \alpha) \cdot K_{fbp} \cdot \cos(\alpha)) \quad (4)$$

where $K_{fbp}$ represents a friction coefficient in the piston block, $K_{fbb}$ represents a friction coefficient in the piston heads, r represents the radius of the piston 8 arrangement, S represents the area of the piston 8, $\alpha$ represents the lift or elevation angle 117 of the cam 9, a represents a length of the piston 8 protruding from the cylinder block 6, b represents a length of the piston 8 remaining within the cylinder block 6, $p_n$ represents the working pressure, and $p_c$ represents the pressure in the discharge or drain channel.

FIG. 33 shows the experimental and calculated values of the driving and resistive torque or moment for the cylinder block 6 based on interaction between the pistons 8 and the cam 9. In particular, curve A represents the experimental driving torque, curve B represents the calculated driving torque, curve C represents the experimental resistive torque, and curve D represents the calculated resistive torque. The values shows in FIG. 33 are for an elevation angle 117 of the cam 9 of approximately 18 degrees.

Experimentally, it has been found that the pressure appears under the piston from the connection to the flow channel or the drain channel when it is connected to the tank cavity in a static state, and reaches a value equal to approximately half of the supply pressure. As an example, if the elevation angle 117 of the cam 9 is approximately 18 degrees and the supply pressure is approximately 50 bar, the driving torque is approximately 1.453 N·m, the tank pressure is at approximately 25 bar, and the resistive torque is approximately 1.271 N·m. In this state, the driving torque is greater than the resistive or friction torque, allowing the system to appropriately function. As a further example, if the elevation angle 117 of the cam 9 is approximately 40 degrees and the supply pressure is approximately 50 bar, the driving torque is approximately 3.554 N·m, the tank pressure is at approximately 25 bar, and the resistive torque is approximately 3.879. In this state, the driving torque is less than the resistive or friction torque, which is problematic. The relationship shown in FIG. 32 can be used to adjust operation of the system to ensure that the driving torque is greater than the resistive torque. In particular, the relationship shown in FIG. 32 and the angle or profile of the cam 9 can be selected to optimize and reduce the loss of power required to operate the rotary pulser. For example, the angle or profile of the cam 9 can be selected to reduce the amount of energy required to rotate the shafts associated with rotating the rotor 14.

Still with reference to FIGS. 1, 4, 5, 16-21 and 28-31, pressure imparted by one cam 9 on a first piston 8 forces rotation of the cylinder block 6 in a clockwise direction, while pressure imparted by the other cam 9 on a second piston 8 forces rotation of the cylinder block 6 in a counterclockwise direction. A shaft 38 extending from the valve 37 can be coupled with a coupler 39 to a shaft 40 of a stepper motor 5 disposed in the distribution unit 120. Thus, due to the coupling between the shafts 38, 40, the valve 37 and the cylindrical block 6, the shafts 10, 38, 40 and the rotor 14 can rotate simultaneously. The shaft 39 of the stepper motor 5 can include a shaft angle sensor 67 mounted thereon. The sensor 67 can provide feedback regarding the angular position of the shaft 10 of the rotor 14, thereby providing feedback regarding the angular position of the rotor 14 relative to the stator 12.

Detailed views of the valve 37 are provided in FIGS. 16-21. In particular, as noted above, the valve 37 can be disposed within the cylindrical block 6. The valve 37 can have a complex configuration of channels formed therein. For example, one group or pair of channels 139 can pass through the body of the valve 37 and connect to the flow channel 27, while a second group or pair of channels 140 can pass through the body of the valve 37 and connect to the drain channel 35. During operation, the stepper motor 5 can be actuated to rotate the valve 37. The valve 37 can be rotated until the pair of channels 139 is connected to two oppositely disposed pistons 8 of the cylinder block 6. High pressure fluid from the flow channel 27 passes through the valve 37 and against the pistons 8. The pistons 8, in turn, direct pressure from the fluid against the cam 9 which results in a moment force that rotates the cylinder block 6. At this time, the second pair of channels 140 can connect with the drain channel 35 to drain the fluid.

As noted above, the cylinder block 6 includes the flow channel 27 that supplies working fluid to the cylinder block 6 under high pressure. The cylinder block 6 also includes the drain channel 51 connected to the drain channel 35. If the stepper motor 5 is actuated to rotate the valve 37 counterclockwise or clockwise, the flow channel 27 of the valve 37 can connect with the channels 32, 34 or the channels 42, 26, respectively. The pistons 8 connected to the flow channel 27, under pressure of working fluid entering the piston cavity, are extended out of the piston cavity formed in the cylinder block 6, while pistons 8 connected to the drain channel 51 are drawn in and the working fluid from the piston cavity flows into the drain channel 35. Upon extension of the piston 8 from the piston cavity, the cam 9 presses on the piston 8, causing rotation of the cylinder block 6. Rotation of the cylinder block 6, in turn, causes rotation of the rotor 14 via the shaft 10 by the same angle and in the same direction as the cylinder block 6. Turning of the rotor 14 can block flow of the drilling fluid 15 through the stator 12 by overlapping the channels 13 of the stator 12 with the blades 114, thereby causing a pressure surge within the channel 7. The pressure surge can be detected or sensed by the telemetry system located on the surface of the earth.

In some embodiments, the energy storage unit 122 can be disposed within the distribution unit 120. In some embodiments, the energy storage unit 122 can be disposed outside of a distal portion of the distribution unit 120. The energy storage unit 122 includes a cup-shaped housing 23 defining the bottom and side portions of the energy storage unit 122. The energy storage unit 122 further includes a cover 31 defining the top portion and separating the energy storage unit 122 from the distribution unit 120. The chamber between the housing 23 and the cover 31 includes a piston 30 disposed therein. The piston 30 divides the chamber into two cavities 28, 29, e.g., chambers.

The cavity 29 is filled with working fluid under high pressure and includes a channel 25 formed in the distal end of the housing 23. The channel 25 fluidically connects the cavity 29 to a pressure line 130 of a pump 2, e.g., a variable pump, or the like. The cavity 29 can be fluidically connected with the valve 37 via the flow channel 27. In some embodiments, a pressure sensor 17 and a relief valve 68 can be disposed within the flow channel 27 adjacent to the inlet to the cavity 29. The cavity 28 includes a channel 33 in a side wall of the housing 23. The cavity 28 is fluidically connected via channel 33 to the drain channel 35. The cavity 28 and the channel 33 can be filled at a pressure substantially equal to the pressure of the drilling fluid 15. The energy storage unit 122 includes a spring 24, e.g., a compression spring, disposed within the cavity 28. The spring 24 is positioned on one side against the cover 31 and on the other side against the piston 30, thereby causing the piston 30 to compress the fluid in the cavity 29. The piston 30 includes a seal 22 disposed around the perimeter of the piston 30 to prevent leakage of the working fluid under high pressure from the cavity 29 into the cavity 28. During use, the cavity 29 is filled with working fluid under high pressure such that the spring 24 is compressed and the piston 30 moves in the direction of the cover 31. The compressed spring 24 acts as a storage or accumulation of energy. When the spring 24 expands against the working fluid in the cavity 29, the energy is released.

The pump assembly 124 includes a pump 2, e.g., a variable pump, and a regulator mechanism 132. The regulator mechanism 132 can be disposed distal relative to the pump 2. The pump assembly 124 includes a suction line 21, e.g., a pump intake, fluidically connected to the drain channel 35 and passing through the wall of housing 45. The pump 2 can take in working fluid from the drain channel 35 through the suction line 21. In some embodiments, the pump 2 includes a filter 69 mounted on the housing 56, e.g., a cylindrical body, of the pump 2 for filtering the working fluid taken in by the pump 2 through the suction line 21.

The electro-mechanical unit 126 includes a motor 1 (e.g., an electric motor) and an electronic control unit 52. The electronic control unit 52 can include an electrical panel fixed within the housing. The electrical panel can include three main units: a voltage conversion unit 134, an electric motor control unit 136, and a motor driver unit 138. The voltage conversion unit 134 can provide power to the electronic components having various voltage ratings. The electric motor control unit 136 can provide power to the motor 1. The work generated by the rotary pulser 100 can be limited by the input source of energy providing power to the motor 1. The motor driver unit 138 can provide control signals for driving the motor 1. The electronic control unit 52 can include one or more current and/or voltage sensors for monitoring and collecting information relating to power usage and distribution within the rotary pulser 100. Feedback signals obtained from the rotary pulser 100 can be implemented to optimize generation of a variety of pulses by adapting the system parameters to the external conditions and conditions occurring during the drilling operation.

In some embodiments, the rotary pulser 100 and/or the drilling bore 3 can include one or more sensors that monitor or track the external working conditions of the rotary pulser system. In some embodiments, one or more sensors can measure the flow of the drilling mud or fluid in the drilling bore 3. In some embodiments, one or more sensors can measure the pressure of the drilling mud or fluid in the drilling bore 3. Based on the signals received from the flow and/or pressure sensors (depending on the conditions of the system) regarding the flow and/or pressure of the drilling mud or fluid, the electronic control unit 52 can adapt and match the desired shape of the master signal or pulse for the rotary pulser 100. Based on the signals received from the flow and/or pressure sensors, the electro-mechanical unit 126 can generate command signals for turning the rotary pulser 100 on or off to conserve battery power, resulting in an efficient operation of the rotary pulser 100.

The signal to activate the motor 1 from the electronic control unit 52 can serve as a pressure reduction within the cavity 29 of the energy storage unit 122. The pressure reduction in the cavity 29 can be sensed by the pressure sensor 17 disposed in the flow channel 27. In particular, activating the motor 1 can activate the pump 2, ensuring an increase in pressure in the cavity 29 up to a predetermined level. Upon reaching the required level of pressure in the cavity 29, the motor 1 can be switched off again.

The hydraulic drive gear ratio i of the pump 2 can be varied by the regulator mechanism 132, e.g., a hydraulic drive mechanism, disposed in the pump assembly 124. The regulator mechanism 132 can include a disc tilt drive 55, a disc 53, and two or more linkages 54 mechanically coupled to the disc 53. The disc tilt drive 55 includes a shaft 20 extending distally therefrom. The shaft 20 can be mechanically linked to a shaft 18 of the electro-mechanical unit 126, e.g., the shaft 18 can extend from the motor 1, via a coupler 19. The shafts 10, 38, 40, 20, 28 can be aligned relative to each other along a central longitudinal axis of the rotary pulser 100. Thus, rotation of the shaft 18 driven by the motor 1 can rotate the shaft 20, thereby driving components of the disc tilt drive 55. As described herein, the disc tilt drive 55 can regulate the position of the linkages 54 to vary the tilt angle of the disc 53, thereby changing the gear ratio i of the pump 2. Varying the tilt angle of the disc 53 thereby changes the parameters of operation of the pump 2. Change in the gear ratio i can occur due to a change of the working volume of the pump 2 caused by the varied tilt angle of the disc 53.

Figure 7:
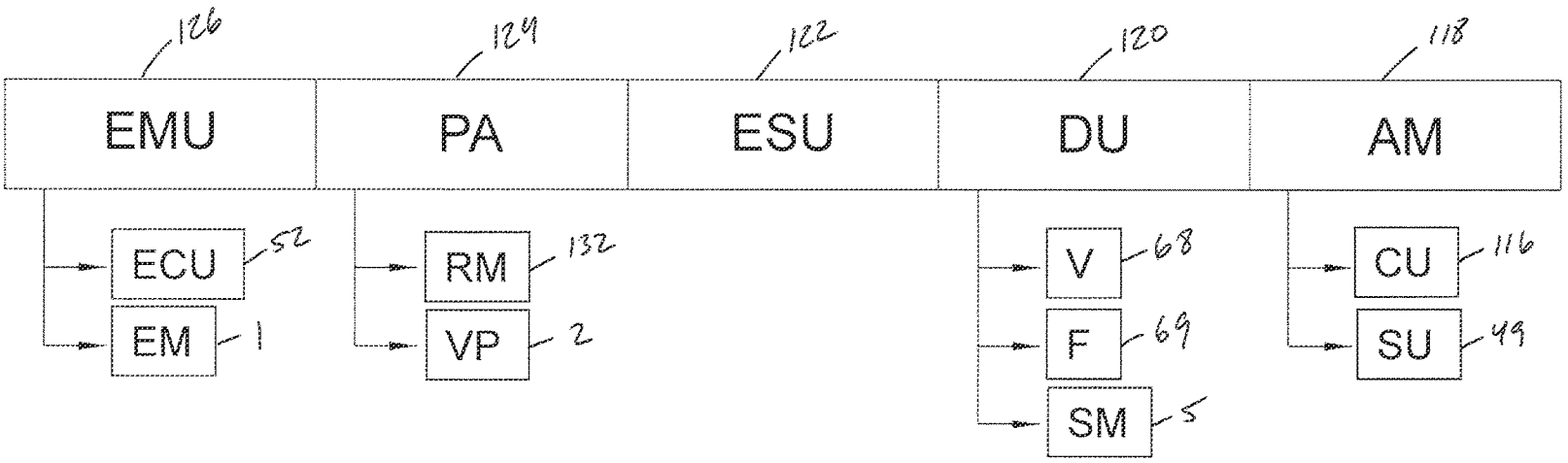
FIG. 7 is a block diagram of an exemplary telemetry system for a rotary pulser according to the present disclosure.

FIG. 7 shows a block diagram of the exemplary telemetry system for the rotary pulser 100. As discussed above, the rotary pulser 100 includes an actuation mechanism 118, a distribution unit 120, an energy storage unit 122, a pump assembly 124, and an electro-mechanical unit 126. The actuation mechanism 118 generally includes a compensation unit 116 and a seal unit, e.g., the tip 49. The distribution unit 120 generally includes a valve 68, a filter 69, and a stepper motor 5. The pump assembly 124 generally includes a regulator mechanism 132 and a pump 2. The electro-mechanical unit 126 generally includes an electronic control unit 52 and a motor 1.

Figure 15:
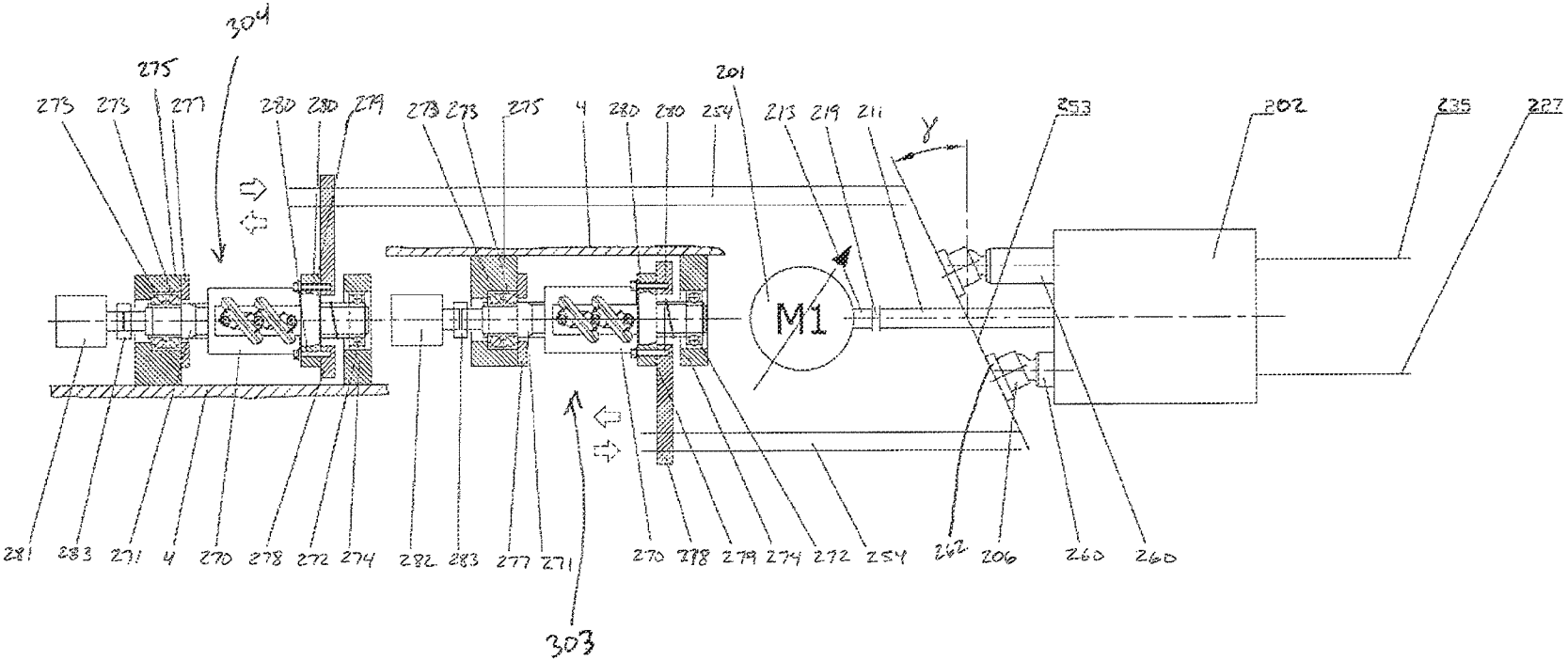
FIG. 15 is a diagrammatic view of a second embodiment of an exemplary regulator mechanism for a rotary pulser according to the present disclosure.
Figure 16:
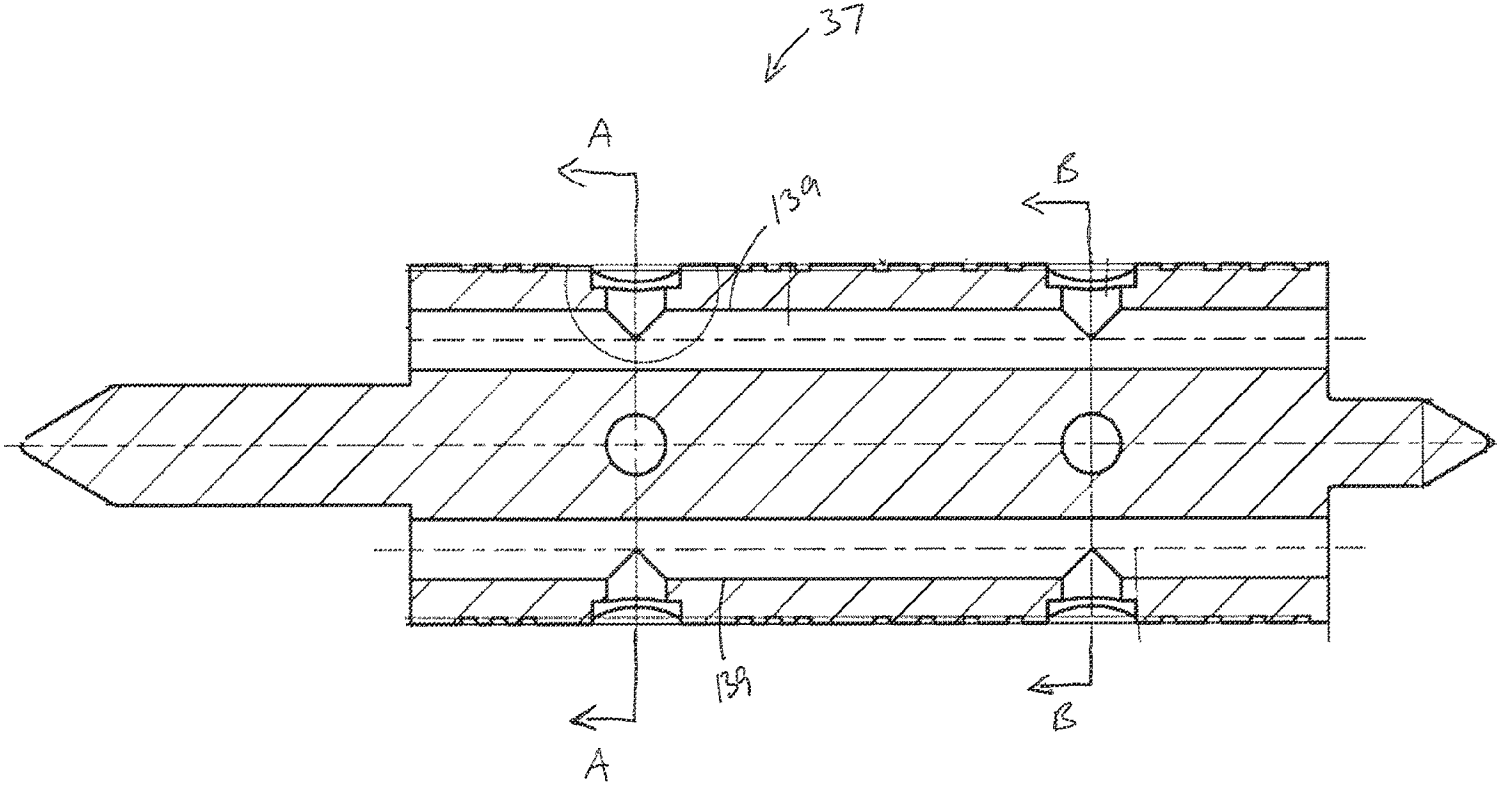
FIG. 16 is a cross-sectional view of a main control spool valve of an exemplary rotary pulser of FIG. 1.
Figure 17:
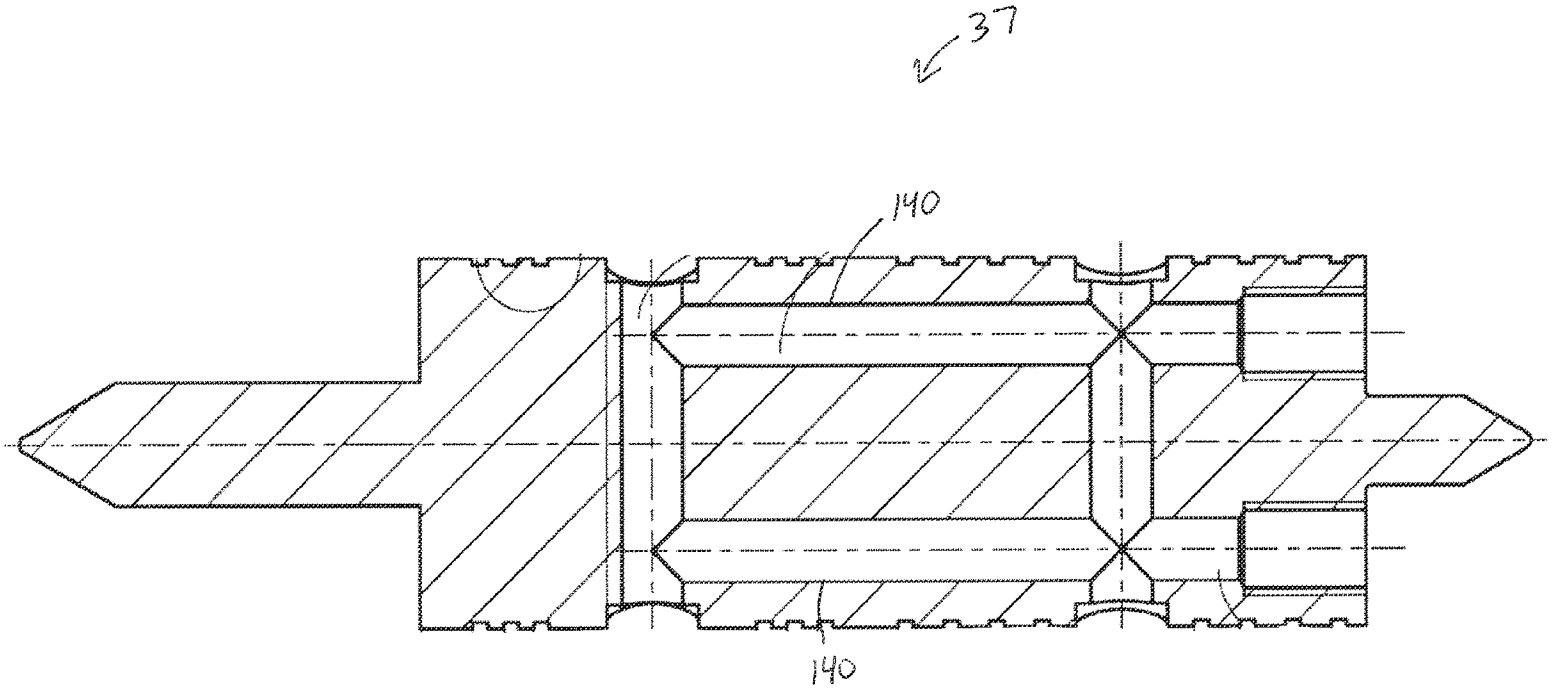
FIG. 17 is a cross-sectional view of a main control spool valve of an exemplary rotary pulser of FIG. 16.
Figure 18:
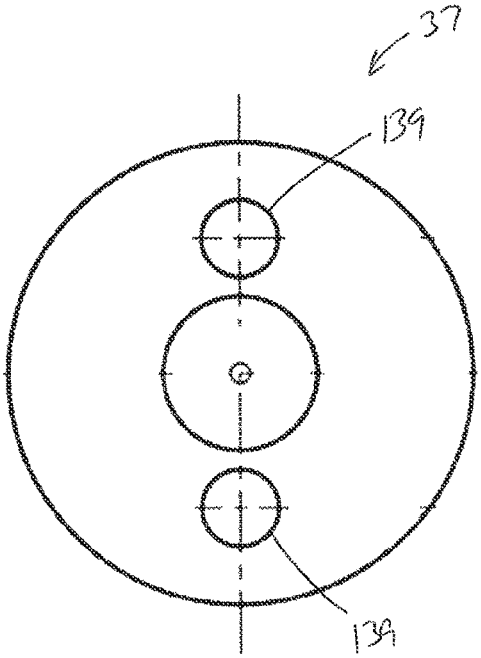
FIG. 18 is a left side view of a main control spool valve of an exemplary rotary pulser of FIG. 16.
Figure 19:
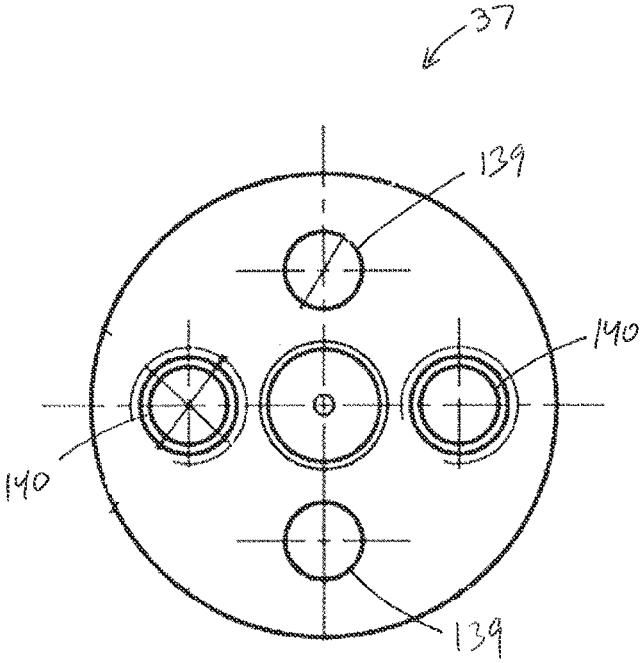
FIG. 19 is a right side view of a main control spool valve of an exemplary rotary pulser of FIG. 16.
Figure 20:
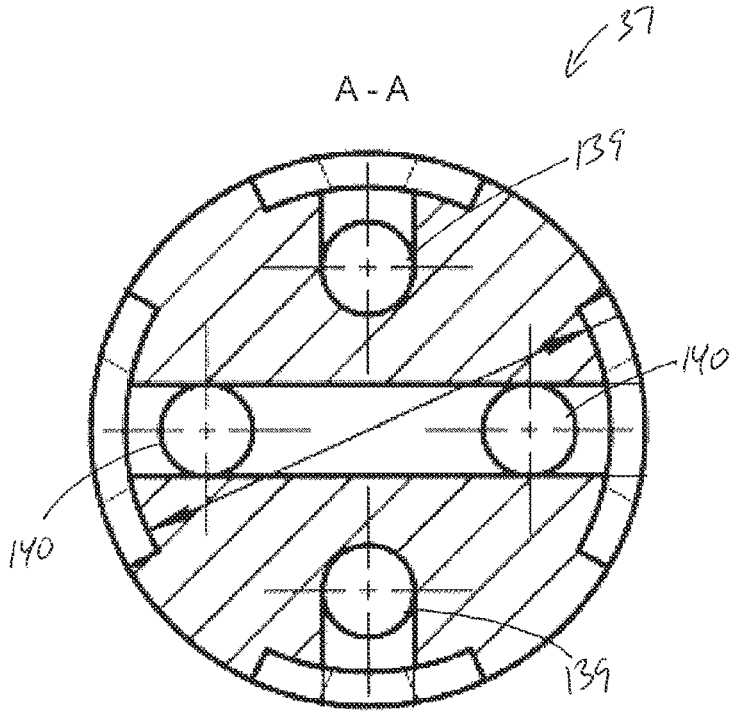
FIG. 20 is a cross-sectional view of an exemplary rotary pulser of FIG. 16 along section A-A.
Figure 21:
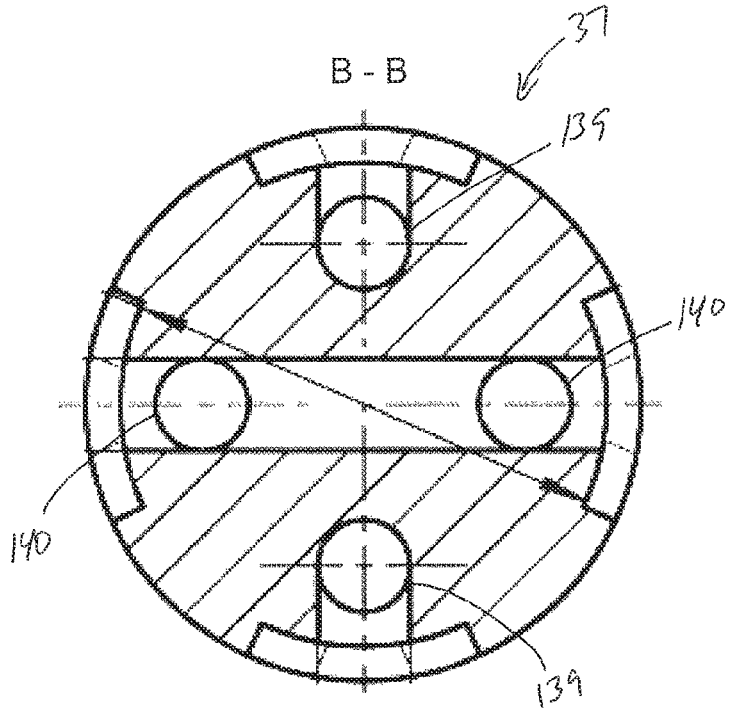
FIG. 21 is a cross-sectional view of an exemplary rotary pulser of FIG. 16 along section B-B.

Although some of the components of the rotary pulser 100 are shown as a subgroup of the main sections of the rotary pulser 100, it should be understood that the components can be positioned in different locations of the rotary pulser 100. In particular, the units shown in FIGS. 7 and 8 can be constructed as separate and independent units relative to each other, thereby providing a modularity to the rotary pulser system. In addition, the units can be modularly constructed such that differing circuit designs can be used. In some embodiments, certain components of the rotary pulser 100 are be interchanged or replaced to vary the components of the rotary pulser 100, while maintaining the functionality and variability of the pump via regulation of the disc tilt angle. Certain components or blocks can be added or removed. For example, a servicing block can be added to the rotary pulser 100 to monitor the operation and regulation of the rotary pulser system. As a further example, the regulator mechanism for the pump can be interchanged between a hydraulic actuator (e.g., FIG. 9), an electromechanical actuator (e.g., FIG. 15), or the like. The overall appearance and variable pump operation of the rotary pulser 100 remains substantially the same, while permitting modularity in the design of the rotary pulser system.

Figure 8:
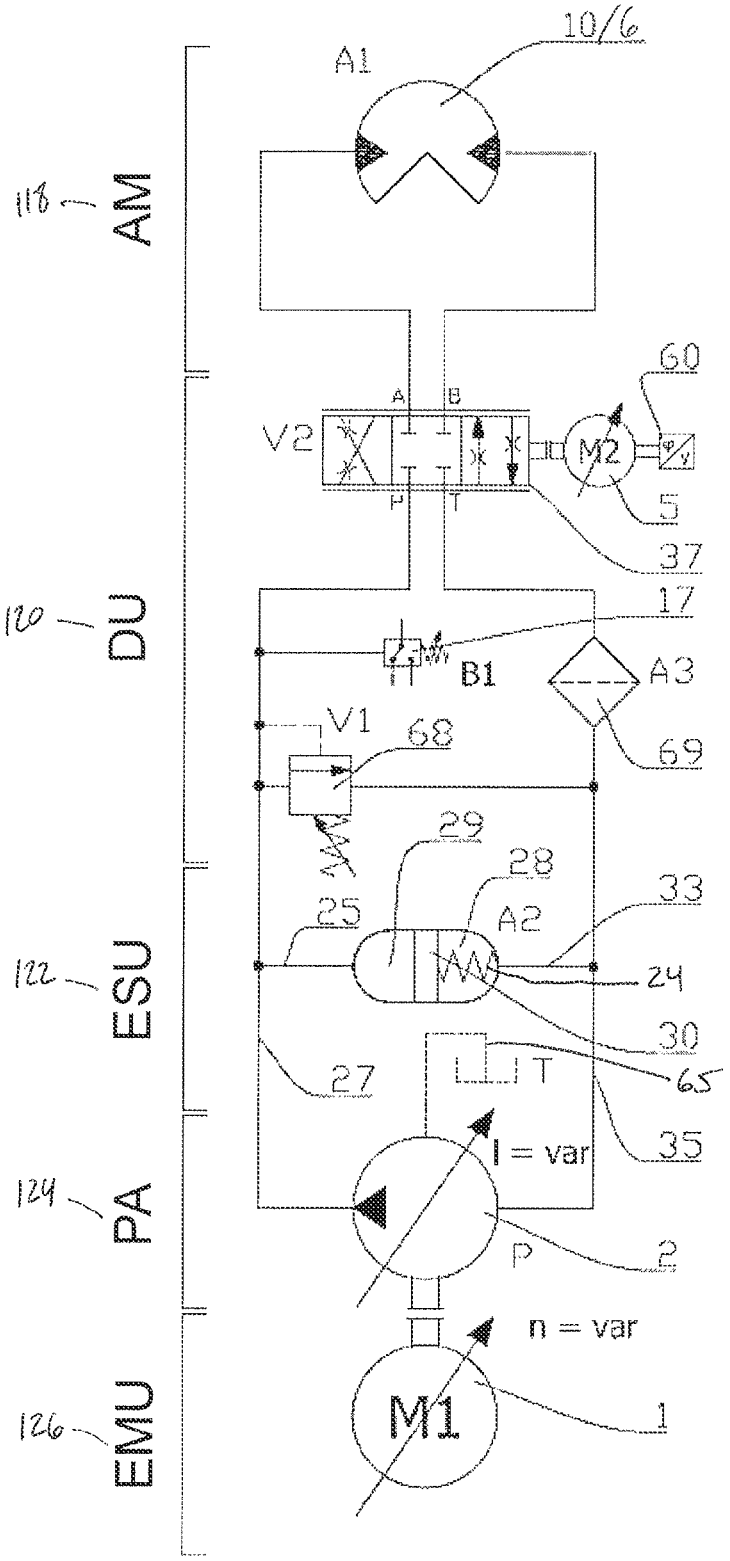
FIG. 8 is a schematic of a first embodiment of an exemplary hydraulic telemetry system for a rotary pulser according to the present disclosure.
Figure 9:
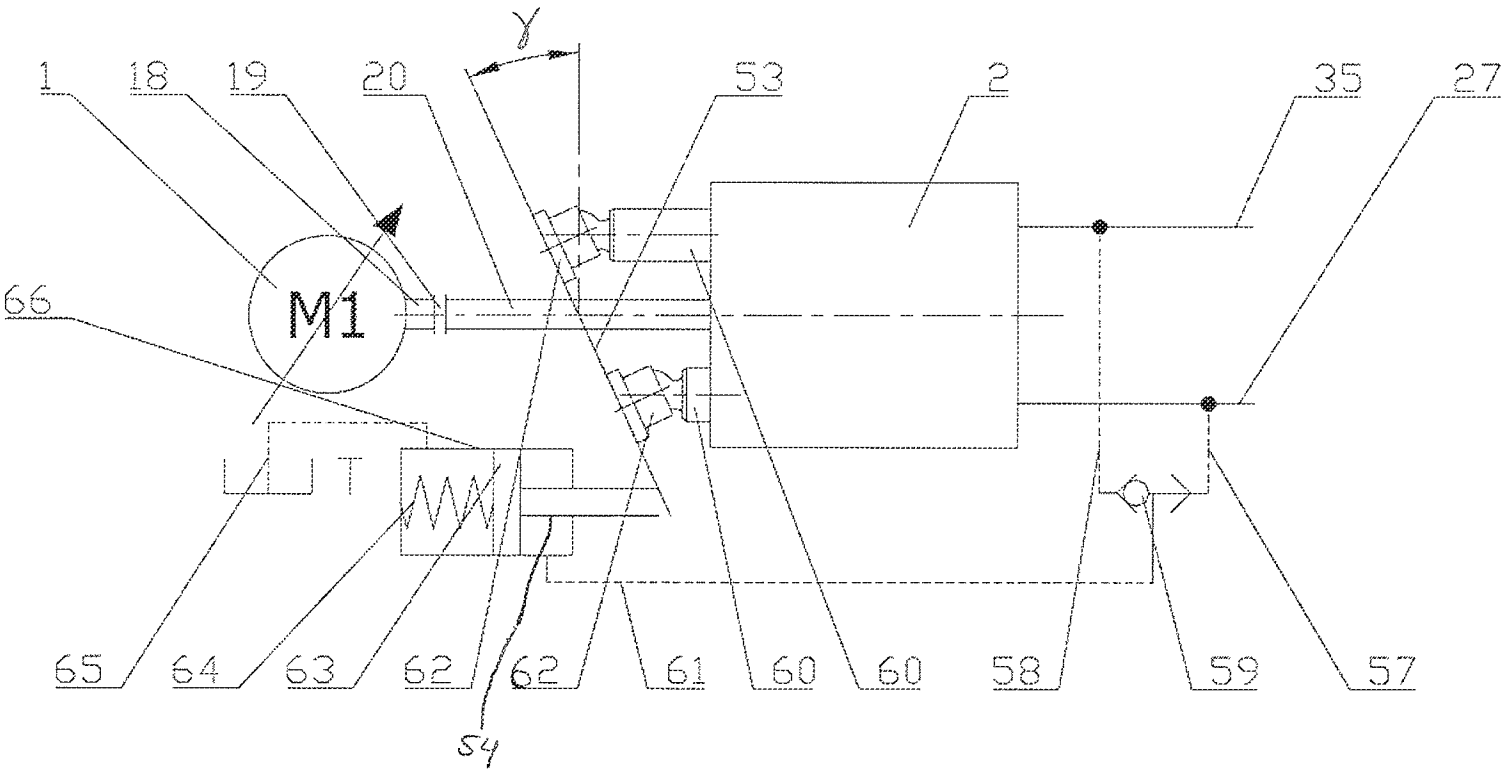
FIG. 9 is a diagrammatic view of a first embodiment of an exemplary regulator mechanism for a rotary pulser according to the present disclosure.

With reference to FIGS. 8 and 9, a block control diagram of an exemplary telemetry system and a diagrammatic view of the regulator mechanism 132 for the rotary pulser 100, respectively, are provided. The designation A can represent actuators, the designation V can represent valves, and the designation T can represent a tank. The pump 2 includes two or more pistons 60 extending distally therefrom. Each piston 60 includes bearings 62 at the end of the piston 60 connected to the disc 53, thereby rotatably fixing the disc 53 to the motion of the pistons 60. Thus, change in the angle of inclination of the disc 53 changes the forces imparted by the disc 53 on the pistons 60, thereby changing the parameters within the pump 2.

The regulator mechanism 132 can include a hydraulic cylinder 66, e.g., a single-action hydraulic cylinder, mechanically connected to the linkages 54 which are, in turn, connected to the disc 53. The single-action hydraulic cylinder 6 provides a control mechanism that provides traction or grip for accurately regulating the variation in angle of the disc 53. The hydraulic cylinder 66 defines a housing in which a piston 63 and a spring 64, e.g., a compression spring, are disposed. A suction line 65 from a tank T can be fluidically connected to the housing of the hydraulic cylinder 66. As discussed above, the shafts 18, 20 can be mechanically linked relative to each other with a coupler 19 such that rotation of the shaft 18 by the motor 1 rotates the shaft 20 of the pump 2.

The regulator mechanism 132 sets the required tilt angle of the disc 53 with the mechanical linkages 54. In some embodiments, the linkages 54 can be fixed and the pump 2 can be used at an unregulated selected/predetermined value for operation of the pump 2 at a predetermined gear ratio i. In the embodiment shown in FIGS. 8 and 9, the linkages 54 can be used in conjunction with the hydraulic cylinder 66 to drive variation of the disc 53 angle. Operation for varying the tilt angle of the disc 53 can be as described below.

In particular, working fluid, e.g., hydraulic fluid, from a high pressure cavity 59 enters a control line 61 of the hydraulic cylinder 66 via channel 58 or channel 57, depending on which direction the shaft 20 of the pump 2 is rotated (in the case of a reversible or variable pump 2 and a motor 1). In some embodiments, the high pressure cavity 59 and the channels 57, 58 can be disposed in the disc tilt drive 55 (see FIG. 1). The working fluid from the high pressure channel 58 or 57 is supplied to the rod end of the hydraulic cylinder 66. In the embodiment shown in FIG. 10, the rod of the piston 63 can be formed as the linkage 54. Thus, the working fluid can be supplied to the side of the piston cavity defined by the housing of the hydraulic cylinder 66 with the linkage 54 to vary the pressure within the piston cavity. The spring 64 can abut the interior wall of the housing of the hydraulic cylinder 66 on one side, and press against the piston 63 on the opposing side. Introduction of the working fluid into the piston cavity can vary the force imparted on the piston 63, thereby varying the position of the piston 63 and the linkage 54.

In the initial state, the spring 64 can be expanded to a maximum expansion position, thereby setting the piston 63 and the associated rod, e.g., the linkage 54, to the rightmost position (see, e.g., FIG. 9). The rightmost position of the piston 63 indicates the maximum angle $\gamma$ of inclination of the disc 53 (i.e., $\gamma_{max}$). The rightmost position of the piston 63 also indicates the minimum force exerted on the piston 63 ($F_{piston1}$) by the working fluid in the piston cavity, which can be proportional and corresponds to a minimum pressure $P_{min}$ within the piston cavity from the working fluid and imparted on the shaft 10 of the actuator. The rightmost position of the piston 63 can be considered as the $x_{min}$ position, e.g., a position of minimum displacement, that corresponds to the maximum angle of inclination $\gamma_{max}$ of the disc 53 relative to a normal or planar position of the disc 53. The maximum angle of inclination $\gamma_{max}$ of the disc 53 provides the maximum flow of the pump 2 and the maximum rotational speed of the rotor 14 with a minimum load on the shaft 10 of the actuator. In particular, the maximum angle of inclination $\gamma_{max}$ provides the maximum flow of working fluid from the pump 2, through the pressure line 130, and into the cavity 29. The high pressure build-up in the cavity 29, in turn, actuates the stepper motor 5 to rotate the cylindrical block 6 and the shaft 10 of the rotor 14 at the maximum rotational speed. It should be noted that working fluid can pass from the pump 2 to the distribution unit 120 through the energy storage unit 122.

Introduction of working fluid through the channels 58 or 57 into the piston cavity can impart a force on the rod end of the piston 63, causing the piston to translate under the influence of the increasing load to a maximum amount of force $F_{piston2}$. The maximum amount of force $F_{piston2}$ imparted on the piston 63 corresponds to the maximum pressure level $P_{max}$ within the piston cavity and imparted on the shaft 10 of the actuator, thereby compressing the spring 64. Movement of the piston 63 to the leftmost position (e.g., $x_{max}$) causes a tilt angle change of the disc 53 to the amount $\gamma_{min}$, e.g., a tilt angle in the maximum and opposing direction from $\gamma_{max}$. The leftmost position of the piston 63 can correspond to the minimum flow of the pump 2 and the minimum rotational speed of the rotor 14.

The relationship between the tilt angle of the disc 53 and the flow of the pump 2 can be represented by Equation 5 below:

$$Q_p = \frac{V_{op} \cdot \omega}{2 \cdot \pi} \cdot \eta_0 \frac{\tan\gamma}{\tan\gamma_{max}} \tag{5}$$

where $Q_p$ represents the pump flow, $V_{op}$ represents the pump displacement, $\omega$ represents the rotational speed of the pump shaft, $\eta$ represents the volume efficiency, $\gamma$ represents the angle of inclination of the disc, and $\gamma_{max}$ represents the maximum angle of inclination of the disc. Thus, the smaller the angle of inclination of the disc ($\gamma$), the smaller the pump flow.

The regulator mechanism 132 with the hydraulic cylinder 66 therefore acts as a hydraulic gear ratio regulator that varies the parameters of the rotary pulser by adjusting the angle of inclination of the disc 53. For example, the angle or pitch of the disc 53 can be increased when no load is imparted on the shaft 10. As a further example, if a load is imparted on the shaft 10, the pressure can increase and the angle or pitch of the disc 53 can decrease. As described above, changing the pitch of the disc 53 results in a change in frequency of the rotary pulser.

Figure 10:
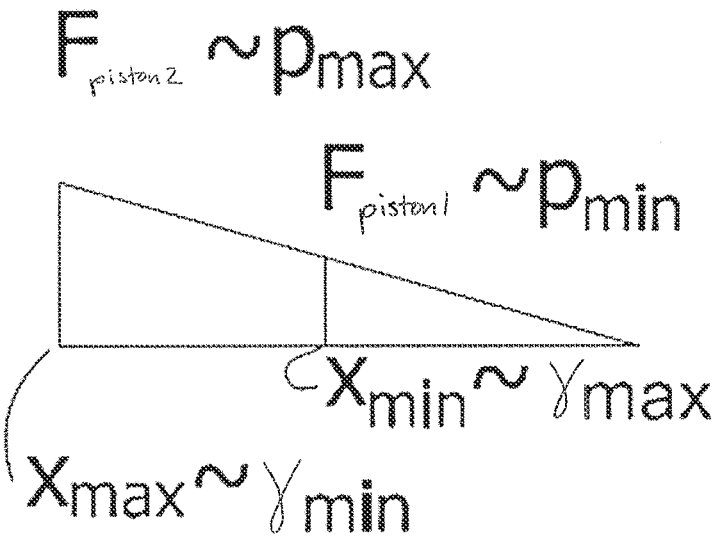
FIG. 10 is a diagrammatic representation of relationships between loads, pressure and displacement for an exemplary regulation system for a rotary pulser according to the present disclosure.

FIG. 10 shows a diagrammatic representation of the relationships between the force, pressure, displacement and disc tilt angle for the regulator mechanism 132. The working fluid contained in the piston cavity of the hydraulic cylinder 66 can be forced into a suction chamber disposed within the pump 2 via a suction line 65. Thus, change of the working fluid volume in the pump 2 and in the piston cavity of the hydraulic cylinder 66 can change the gear ratio i of the pump 2, thereby varying the rotational speed of the rotor 10 and the pressure pulses generated by the rotary pulser 100. Thus, the gear ratio i can be varied to operate the rotary pulser 100 at the setting desired by the user.

Figure 11:
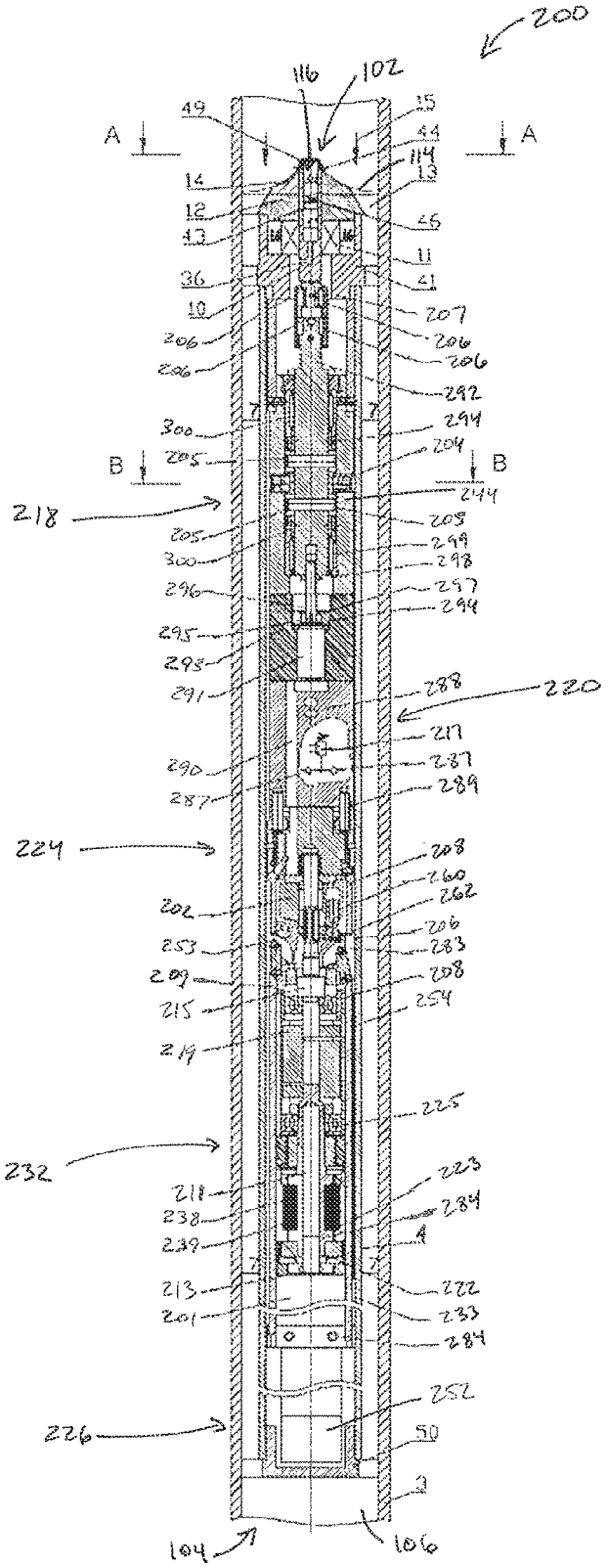
FIG. 11 is a side, cross-sectional view of an exemplary rotary pulser including a second embodiment of a telemetry system according to the present disclosure.
Figure 12:
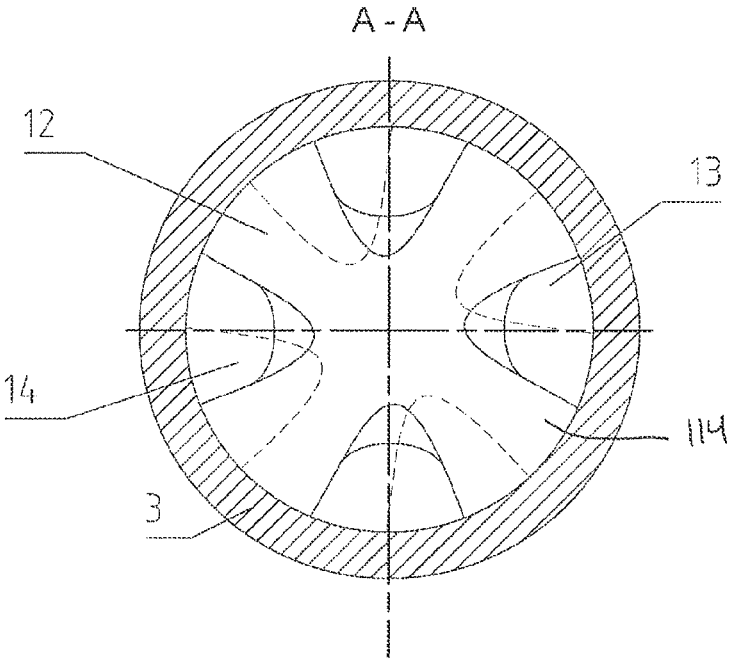
FIG. 12 is a cross-sectional view of an exemplary rotary pulser of FIG. 11 along section A-A.
Figure 13:
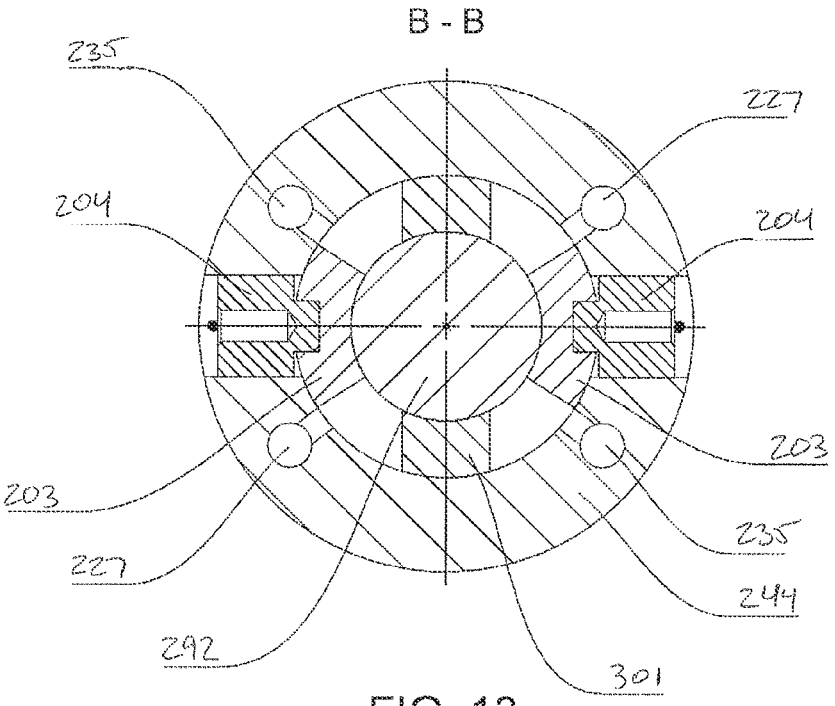
FIG. 13 is a cross-sectional view of an exemplary rotary pulser of FIG. 11 along section B-B.

Turning now to FIGS. 11-13, cross-sectional views of an exemplary rotary pulser 200 are provided. In particular, the rotary pulse 200 can be substantially similar in structure and function to the rotary pulser 100, except for the distinctions noted herein. As such, like reference numbers are used for elements having the same functionality and/or structure as those of the rotary pulser 100.

The rotary pulser 200 is also positionable within a drilling bore 3. The drilling bore 3 and the rotary pulser 4 form the substantially annular channel 7 for providing a passage for drilling fluid 15 to the drill head 106. The cavity in the housing 4 of the rotary pulser 200 bounded by the housing 4 and the covers 41, 50 can be filled with a working fluid, e.g., a hydraulic fluid. Prior to installing the rotary pulser 200 in the drilling bore 3, the cavity can be filled with the working fluid up to a pressure substantially equal to the pressure at a depth of work in the drilling bore 3. The covers 41, 50 can be fixed fitted against the inner surface of the drilling bore 3 and include openings 108, 110, respectively, adapted for allowing passage of the drilling fluid 15 therethrough.

The rotary pulser 200 generally includes an actuator mechanism 218, a pump assembly 224, a regulator mechanism 232, and an electro-mechanical unit 226. The shaft 10 of the rotor 14 can be mechanically connected to a shaft 292 with a coupler 207 and rods 206, e.g., dowels, or the like. In some embodiments, an energy storage unit can be disposed within the shaft 10 and fluidly connects to the drain line of the pump 202 via the channel 36. In some embodiments, the energy storage unit can be disposed between the pump 202 and the distribution unit 220. Interaction of the rotor 14 and stator 12 can be substantially similar to that of the rotary pulser 100 described above. The cross-sectional view along section A-A of FIG. 12 shows the interaction between the blades 114 of the rotor 14 and the channels 13 of the stator 12 to generate the pressure pulses. The shaft 292 can be rotatably secured within the housing 4 with a retainer mechanism 204, pins 205, bearings 299 (e.g., needle roller bearings, or the like), and bearings 300 (e.g., thrust ball bearings, or the like). In some embodiments, a housing 244 can surround at least a portion of the shaft 292, the housing 244 being disposed within the housing 4.

With reference to FIG. 11 and the cross-sectional view of FIG. 13 along section B-B, a quadrant valve is illustrated. In particular, the shaft 292 can be rotated in a range of approximately ±25 degrees. The angular position of the shaft 292 can be limited by two sectors 203 disposed within the housing 244 around the shaft 292 and located opposite each other. Clamps or retainers 204 can secure the sectors 203 against the housing 244 to prevent undesired movement of the sectors 203, resulting in a self-centering mechanism. Mounting of the shaft 292 in the bearings 99, 100 allows for accurate fixation of a rotary piston 301 in both the radial and axial directions and permits small clearances between the housing 244 and the rotary actuator 301 (and other related mating components). The rotary piston 301 can be disposed between the shaft 292 and the housing 244. Mounting of the shaft 292 in the bearing 99, 100 also provides a minimum radial clearance of the actuator mechanism 218. The rotary piston 301 can be mounted within the housing 244 with the pins 205. Supply of the working fluid to the chambers of the actuator mechanism 218 can be performed through channels 227, 235, e.g., bores, passing through the housing 244. The channels 227 can be disposed on opposing sides of the housing 244 relative to each other. Similarly, the channels 235 can be disposed on opposing sides of the housing 244 relative to each other. The channels 227, 235 can be fluidically connected to the pump 202. In addition, pressure changes occurring at the rotor 14 can be transmitted to the channels 227, 235.

Figure 14:
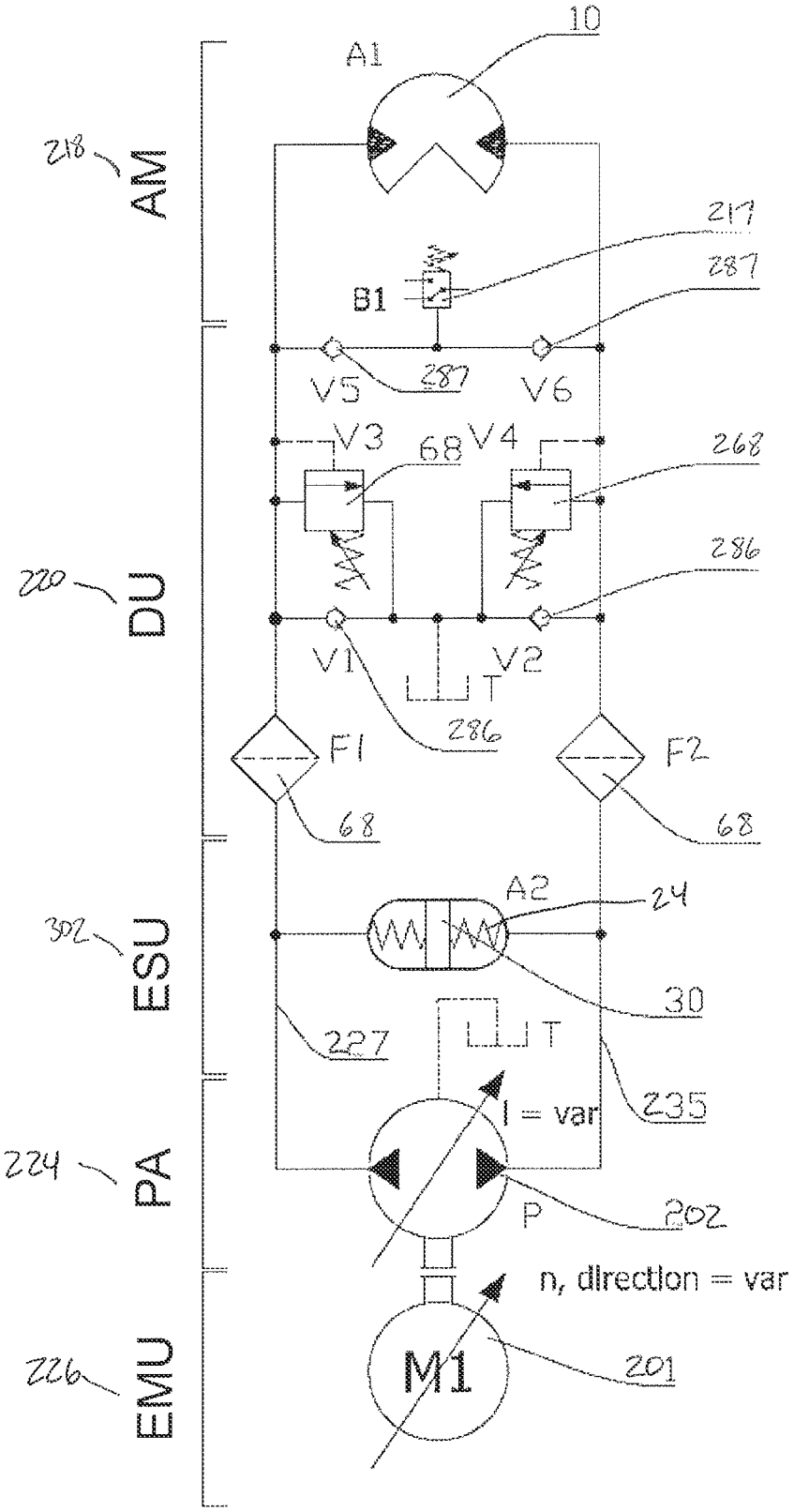
FIG. 14 is a schematic of a second embodiment of an exemplary hydraulic telemetry system for a rotary pulser according to the present disclosure.

Power distribution required for switching between channels 227, 235 connected to the pump 202 can include relief valves 68, e.g., safety valves, disposed within the channels 227, 235 to limit the maximum pressure within the channels 227, 235 (see, e.g., FIG. 14). The rotary pulser 200 can also include pressure equalization valves 286, connecting valves 287, or both, associated with the pressure sensor 217 (see, e.g., FIG. 14). A simultaneous distribution of working liquid can occur in the housing 288 from two channels 227, 235 from the pump 202 into two channels 227, 235 of the actuator mechanism. The relief valves 68 can recirculate the working liquid from channel 227 to channel 235 (and vice versa) upon over-pressurization until the pressure within the housing 288 is lowered to a more acceptable level. Elastomeric seals can be fixed to the housing 288 with the locking pins 289 to create a seal of the channels 227, 235.

The shaft 292 includes a shaft 296 extending from a distal end of the shaft 292 and connecting the shaft 292 to a housing 293. The shaft 296 can be connected to the shaft 292 with a nut 298. The shaft 296 can include a substantially cylindrical head portion 297 at a distal end. The shaft 296 can be connected to the housing 293 with a nut 294 securing the head portion 297 within a bore of the housing 293. In some embodiments, a sensor 291, e.g., an angle sensor, can be disposed within a bore of the housing 293. The housing 288 can include a channel 290 passing therethrough for wiring of the sensor 291 to an electrical source. The sensor 291 can measure the rotational angle of the housing 293, thereby measuring the rotational position of the shafts 296, 292, 10, and the rotor 14.

In some embodiments, the sensor 291 can be a rotary variable differential transformer (RVDT). In some embodiments, the sensor 291 can be mounted in the housing 293 with the nut 294. The sensor 291 can include a shaft 295 which can be connected to the head portion 297 of the shaft 296 with the nut 294. In some embodiments, the shaft 296 can be screwed into the shaft 292, further locked with the nut 298. The interconnection between the shafts 292, 296 ensures a backlash-free connection and compensates for misalignment of the shafts 292, 296.

A housing 288 for the distribution unit 220 can be disposed distal of the housing 293. The housing 288 can include a sensor 217, e.g., a pressure sensor and valves 287. A channel 290 can be formed passing through the length of the housing 288 to fluidically connect the pump assembly 224 to the actuator mechanism 218 through the distribution unit 220. A seal can be created between the pump assembly 224, the distribution unit 220, and the actuator mechanism 218 with, e.g., bushings having radial elastomeric seals. Locking pins 289 can connect the housing 288 to the housing 208 of the pump assembly 224.

The pump assembly 224 can include a housing 208, a pump 202, e.g., a variable pump, and a regulator mechanism 232 disposed therein. The housing 208 of the pump 202 can define a substantially cylindrical form configured to be received by the housing 4 of the rotary pulser 200. The regulator mechanism 232 of the pump assembly 224 includes pistons 260 (e.g., two or more pistons) movably securing by a piston support 262, bearings 206, and a disc 253 capable of being tilted. In some embodiments, the pump assembly 224 (including the regulator mechanism 232) can include seven pistons 260 circumferentially disposed and secured relative to the disc 253. Linkages 254 can be mechanically connected to the disc 253 with couplers 283. In some embodiments, the housing 208 can include a window 209 through which the disc tilt mechanism can be viewed. The regulator mechanism 232 can include a shaft 215 extending into and mechanically linked to the housing 288. The shaft 215 can include a coupler 219 positioned around and surrounding a portion of the shaft 215.

The regulator mechanism 232 further includes a shaft 211 rotatably positioned within a housing 284 which is disposed within the housing 4. Bearings 225 can be positioned within the housing 284 to permit rotation of the shaft 211 within the housing 284. The shaft 211 can be mechanically connected to a shaft 213 of a motor 201 with a coupler 222. The shafts 10, 192, 296, 215, 211, 213 can be aligned relative to a central longitudinal axis of the rotary pulser 200.

The electro-mechanical unit 226 includes the motor 201 and, in some embodiments, can include a housing surrounding at least a portion of the motor 201. The electro-mechanical unit 226 includes a sine-cosine rotating transformer (SCRT) 84 connected to the motor 201. The electro-mechanical unit 226 further includes an electric control unit 252. The SCRT 84 includes a rotatable component 239 connected to a rotary transformer 238, e.g., a slip ring, mounted on the shaft 211 within the housing 284. The bearings 225 can be used to ensure the uniformity of a radial gap 223 between the mobile component 239 and the annular supply transformer 238. Centering of the housing of the motor 201 relative to the housing 208 of the pump 202 can be performed by an external bushing 233. The bushing 233 can include slots formed therein for passage of linkages 254 for driving the pump 202. The bushing 233 can also include openings formed in the housing 284 for passage of wires to and from the motor 201. Residual misalignment between the shafts 211, 215, 213 of the pump 202 and the motor 201 can be compensated for by the coupler 219, e.g., an elastic, multi-plate coupler, or the like.

Still with reference to FIG. 11, and also with reference to FIGS. 14, 15 and 34-39, a block control diagram of an exemplary telemetry system, a diagrammatic view of the regulator mechanism 232 for the rotary pulser 200, detailed views of the pump assembly 224, and detailed views of a disc 243, respectively, are provided. The designation A can represent actuators, the designation V can represent valves, the designation F can represent filters, the designation T can represent a tank. As can be seen in FIG. 14, in some embodiments, the rotary pulser 200 can include an energy storage unit 302. The energy storage unit (ESU) 302 can include a piston 30 with springs 24. The piston 30 can be fluidically connected to the channels 227, 235. In the rotary pulser 200, the energy storage unit 302 can act as a hydraulic compensation mechanism. In particular, as the hydraulic compensation mechanism, the energy storage unit 302 can compensate for variations in temperature of the working fluid and maintains the minimum pressure in the system. The electro-hydraulic drive mechanism of the rotary pulser 200 includes a variable pump 202 that provides a change in the gear ratio i with the assistance of a hydraulic drive mechanism of the regulator mechanism 232. In particular, the regulator mechanism 232 can vary the angle of inclination of the disc 253, thereby allowing variation of the parameters of the pump 202 operation. Varying the parameters of the pump 202, the motor 1 and/or the angle of inclination of the disc 253 with the regulator mechanism 232 varies the speed of rotation of the rotor 14 which, in turn, changes the frequency and/or amplitude of the signal generated by the drilling fluid passing through the rotary pulser 100. The change in gear ratio i of the pump 202 can occur due to a change of the working volume of the pump 202. The mechanical connection (e.g., rotatable fixation) between the shaft 215 and the shaft 211 of the regulator mechanism 232 with the coupler 219 permits rotational actuation of the shafts 211, 215 to change the angle of inclination of the disc 253. The units shown in FIG. 14 can be constructed as separate and independent units relative to each other, thereby providing a modularity to the rotary pulser system. In addition, the units can be modularly constructed such that differing circuit designs can be used.

With specific reference to FIGS. 15 and 34-40, the rotary pulser 200 includes the pump 202 with channels 235, 227 extending therefrom for passage of the working fluid. Although discussed herein with respect to the rotary pulser 200, it should be understood that the features of the rotary pulser 200 can be incorporated into the rotary pulser 100. Two or more pistons 260 can movably extend from the pump 202. In some embodiments, the rotary pulser 200 can include seven pistons 260 circumferentially extending from the pump 202 and circumferentially connected to the disc 253 (see, e.g., FIG. 40). In particular, the pistons 260 can be spaced relative to each other and can be circumferentially positioned about a central longitudinal axis of the rotary pulser 200. The pistons 260 can further connect to the disc 253 at a position spaced from the outer edge of the disc 253. Implementing multiple pistons 260 allows for smoother and more accurate regulation of the pump 202 when the disc 253 is tilted. A distribution disc 306 can be mechanically connected to the pistons 260 at an end opposing the connection with the disc 253. During each pistons 260 stroke, the distribution disc 306 is actuated or moved to create either a suction or a pressure stroke, thereby either taking fluid into the pump 202 assembly or ejecting the fluid into the hydraulic system.

Each piston 260 includes a bearing 206 on an end portion of the piston 260, the bearing 206 being connected to the disc 253. The bearings 206 can be sliding bearings that support the pistons 260 with piston supports 262. A pressure support plate 305 can assist in pressing and maintains the piston supports 262 against the disc 253. The shaft 213 of the motor 201 can be mechanically linked to the shaft 211 of the pump 202 with the coupler 219 such that the shafts 211, 213 rotate together. The rotary pulser 200 includes first and second actuator assemblies 303, 304 connected to the disk 253 by linkages 254, respectively. In some embodiments, two or more linkages 254 can be implemented. The first and second actuator assemblies 303, 304 can be used to vary the tilt angle of the disc 253. The first and second actuator assemblies 303, 304 can be aligned relative to each other, the motor 201, and the pump 202 along a central longitudinal axis of the rotary pulser 200.

Each of the first and second actuator assemblies 303, 304 includes two bearing housings 274, 275 for mounting of bearings 272, 273, respectively, therein. The bearing housings 274, 275 can be secured to an inner wall of the housing 4. The bearing housing 275 includes a cover 277 that protects and seals the bearings 273 within the bearing housing 275. The cover 277 also assists in maintaining the bearings 273 within the bearing housing 275. The first and second actuator assemblies 303, 304 include a helical gear drive, the helical gear drive including a screw 271 configured to rotatably pass through and mesh with complementary internal components of a carriage 270. The ends of the screws 271 can be positioned in the bearings 272, 273 to allow rotation of the screws 271 along the central longitudinal axis. The bearings 272, 273 and the screws 271 act as a control mechanism that provides traction or grip for accurate and controlled adjustment of the angle of the disc 253.

Each carriage 270 includes a circumferential flange 279 extending therefrom. The flange 279 can be fixedly secured to a flange 278 with screws 280 such that the flange 278 extends from the carriage 270 in a substantially perpendicular manner relative to the central longitudinal axis. The linkages 254 can be rigidly mounted to the respective flanges 278. Thus, as shown by the solid and dashed arrows in FIG. 15, movement of the screw 271 within the carriage 270 is transmitted to the flange 278 and actuates movement of the linkages 254, thereby varying the tilt angle of the disc 253. Movement of the linkages 254 can be substantially parallel to the housing 4.

The first and second actuator assemblies 303, 304 include motors 282, 281, respectively (e.g., stepper motors), for actuating movement of the screw 271 within the carriage 270. The motors 281, 282 can be mechanically linked to the endpoint, e.g., shafts, of the screws 271 by couplers 283. In some embodiments, a shaft angle sensor can be incorporated with the screws 271 for detecting the angular position of the screws 271 relative to the carriages 270.

FIGS. 35-39 show detailed views of the disc 253. Although discussed herein with respect to the rotary pulser 200, it should be understood that a substantially similar disc 253 can be used with the rotary pulser 100. The disc 253 includes a body 255 defining a substantially cylindrical configuration. The body 255 includes a central bore 256 formed therein. The bore 256 can be configured and dimensioned for passage of the shaft 215 therethrough. In particular, the disc 253 can be actuated to tilt relative to a central, longitudinal axis of the rotary pulser 200, while maintaining a distance between the inner surfaces of the bore 256 and the shaft 215. The disc 253 includes a substantially flat top surface 257 surrounding the bore 256. The top surface 257 can fixedly receive thereon the piston supports 262 such that tilting of the disc 253 automatically adjusts the position of the piston supports 262 and, in turn, actuates the pistons 260.

The disc 253 includes a bottom surface 258 opposing the top surface 257. The bottom surface 258 includes two convex surfaces 259 separated by a flange 261. The flange 261 can extend across the width of the disc 253 and includes a hinge mechanism 263 extending from each side of the disc 253. The hinge mechanism 263 includes two spaced flanges 264 with aligned bores 265 passing therethrough. The hinge mechanisms 263 can rotatably or hingedly connect the disc 253 to the linkages 254. In particular, connecting linkages 266 can hingedly connect at one end to the linkages 254 with a pin and can hingedly connect at the opposing end to the hinge mechanisms 263 of the disc 253. Thus, substantially linear translation of the linkages 254 is transferred and converted into tilting of the disc 253.

Figure 40:
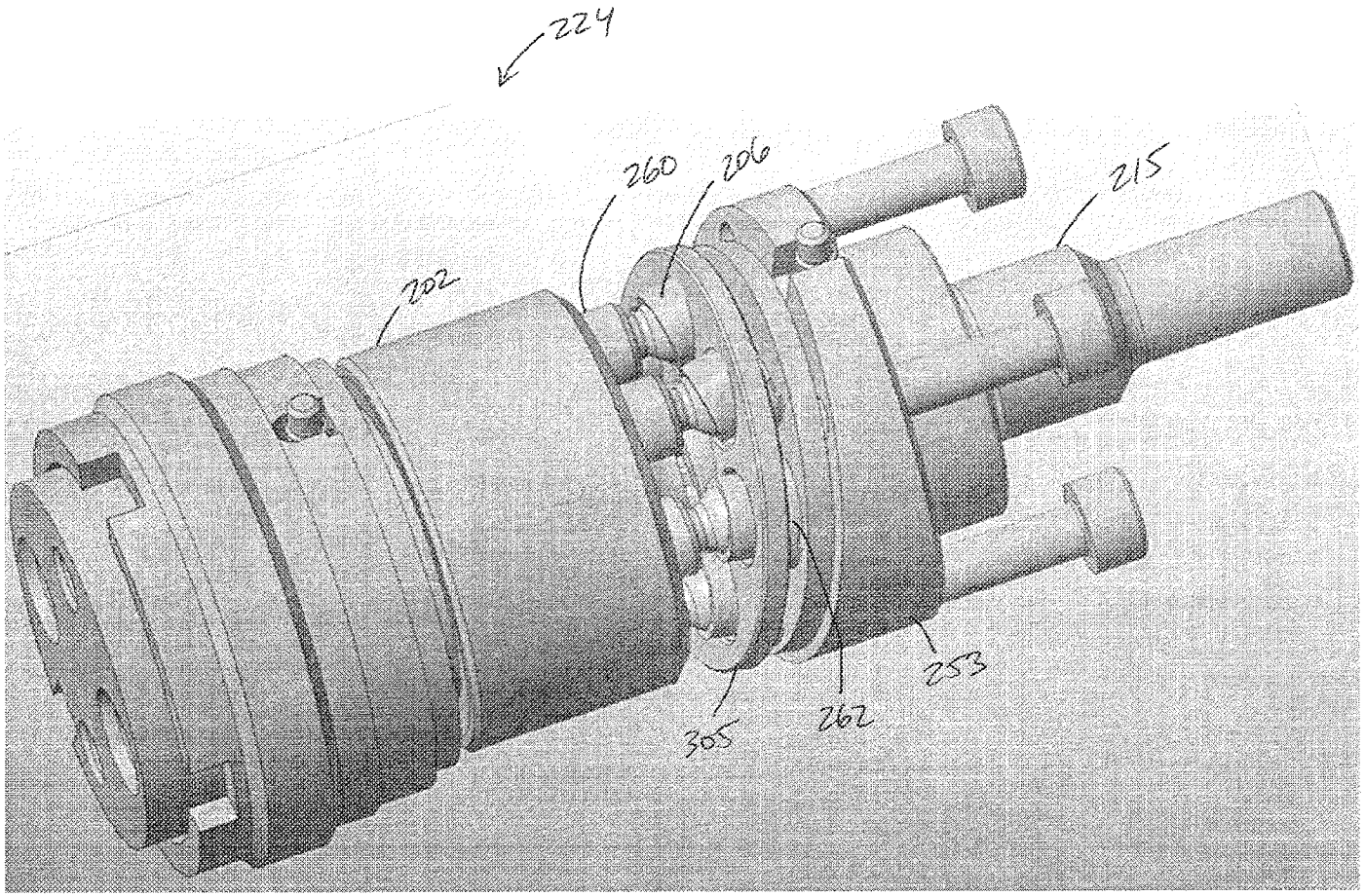
FIG. 40 is a perspective view of an exemplary pump assembly for a rotary pulser of FIG. 14.

In some embodiments, operation of the rotary pulser 200 can be with a fixed position of the disc 253. For example, as shown in FIG. 40, the linkages 254 and the pistons 260 can be fabricated based on desired pump 202 parameters and do not move to vary the tilt angle of the disc 253. Thus, the linkages 254 and the pistons 260 cannot be used to vary the parameters of the pump 202. However, the frequency of rotation of the shaft 211 can be varied to change the parameters associated with operation of the rotary pulser 200. For example, increasing or decreasing the frequency of rotation of the shaft 211, in turn, affects the rotation of the rotor 14 relative to the stator 12, thereby varying the pulse generation of the rotary pulser 200.

In some embodiments, rather than a fixed operation, the pump 202 parameters can be varied by varying the tilt angle of the disc 253. Operation of varying the tilt angle of the disc 253 with the first and second actuator assemblies 303, 304 can be as described herein. In particular, when a load on the output shaft 10 of the rotor 14 changes, the pressure in channels 227 or 235 (depending on the direction in which the shaft 215 of the pump 202 rotates) also changes. The load on the output shaft 10 of the rotor 14 can change based on a variety of operating conditions of the rotary pulser 200. For example, the load on the output shaft 10 can change based on variations in the hydrodynamic force of the working fluid passing through the rotary pulser 200 based on the position of the rotor 14 relative to the stator 12 (e.g., the size of the passage between the rotor 14 and the stator 12). As a further example, the load on the output shaft 10 can change based on the magnitude of the hydrodynamic friction force in the openings passing through the rotor 14 and the stator 12. As a further example, the load on the output shaft 10 can change based on large particles entering the openings passing through the stator 12 and the rotor 14, resulting in a greater load to clear such particles from the stator 12/rotor 14 assembly. As a further example, the load on the output shaft 10 can change to overcome the inertial load of rotating components of the rotary pulser 200, such as the rotor 14, shafts connecting the rotor 14 to the remaining components of the rotary pulser 200, rotating portions of the motor(s), combinations thereof, or the like.

The sum of these forces can change the overall pressure in the hydraulic system. The pressure of the hydraulic system is generally not constant and varies based on the rotation of the rotor 14 relative to the stator 12 and, therefore, the power to overcome the mechanical loads also varies based on the clearance created through the openings of the rotor 14 and stator 12. The change in pressure of the hydraulic system is sensed by the pressure sensor 17. Based on the signal received by the pressure sensor 17, the tilt angle of the disc 253 can be changed, thereby establishing the optimal pressure in the system.

In particular, the pressure change can be detected by the pressure sensor 17. The pressure sensor 17 can be in communication, e.g., electrical communication, with the electronic control unit 252. The electronic control unit 252 can receive a signal from the pressure sensor 17 regarding the change in pressure and, in turn, creates a control signal to the stepper motors 281, 282. The control signal from the electronic control unit 252 can turn the stepper motors 281, 282 such that rotation of the motor 281, for example, will be in a clockwise direction, and rotation of the motor 282 will be in the opposite direction, e.g., counterclockwise. However, it should be understood that the motor 281 can be rotated in the counterclockwise direction and the motor 282 can be rotated in the clockwise direction.

Rotation of the motors 281, 282 can be converted via the ball-screw or helical gear drive transmission into linear motion of the linkages 254. Since the direction of rotation of the motors 281, 282 is opposite, the thrust or motion of the linkages 254 can also move in opposite directions relative to each other. For example, with motion of the top linkage 254 in a leftward direction, the bottom linkage 254 can be moved in a rightward direction. Movement of the linkages 254 translates to rotation and variation of the tilt angle of the disc 253. In particular, when the load on the shaft 10 increases to a value corresponding to a maximum pressure level $P_{max}$, the angle of inclination of the disc 253 can be changed to a value $\gamma_{min}$ (e.g., an angle of the same magnitude as $\gamma_{max}$, but in the opposing direction relative to a planar orientation of the disc 253). Similarly, decreasing the load on the shaft 10 to a value corresponding to a minimum pressure level $P_{min}$, the angle of inclination of the disc 253 can be changed to a value $\gamma_{max}$. Changing the tilt angle of the disc 253 actuates the pistons 260 connected to the pump 202, thereby changing the working volume of the pump 202. Changing the working volume of the pump 202 in turn changes the gear ratio i of the pump 202, thereby changing the parameters of the rotary pulser 200.

The exemplary rotary pulsers described herein advantageously include a regulator mechanism (e.g., a tilting disc mechanism) to automatically change or regulate the gear ratio i during operation of the rotary pulsers based on operating parameters or conditions. In particular, the regulator mechanism allows variation of parameters of the pump to adjustably control drilling operations of the rotary pulser. For example, if the load in the system increases during operation of the rotary pulser, the torque required to turn the rotor increases. Based on the increase in the load on the system, the regulator mechanism can be actuated to adjust the gear ratio i of the pump 202 such that rotor can be rotated more easily (e.g., with a lower torque). Energy consumption from an energy source, such as a battery, can thereby be conserved. For example, the regulator mechanism can be implemented to increase the rotor frequency to approximately 10-16 Hz (e.g., approximately four times that of traditional rotors) without incurring an increase in energy consumption. Thus, higher speeds and/or torques associated with the rotor can be achieved with traditional energy sources (e.g., batteries, turbines, generators, combinations thereof, or the like). The rotary pulsers can thereby be used in an energy efficient manner, while reducing the potential for maintenance issues by reducing the overall load on the components of the system.

With reference to FIGS. 22-27, graphs illustrating a shaft angle, a signal, a moment, and a current for testing of a prototype of an exemplary rotary pulser are provided. During normal operation, the rotary pulser system can undergo disturbances that result in changes in the rotary pulser system over time. Impacts on the rotary pulser system in the field are most often random, causing occasional or undefined processes. Information about the characteristics of random impacts on the hydraulic system of the rotary pulser is limited. As such, studies of the dynamic properties of the system rely on deterministic effects. Typical deterministic effects can be step, impulse, and harmonic. The deterministic effects can be used to monitor the impact on the signals of the system for purposes of solving the issue of stabilizing the system during random impacts. The deterministic effects can also be used to investigate the influence of various factors on the dynamic characteristics of the individual components of the system and the system as a whole.

Testing of a system including complex objects for analysis of the dynamic characteristics of the system can be difficult. Therefore, in practice, testing is typically performed in the time domain. Testing of the system involves determining the effects of stepped, pulsed or harmonic effects. The stepped effects are typically easier to reproduce in real conditions, thereby facilitating the verification of the adequacy of the calculations and resulting experiments of changing processes of the system. The stepped effects on the system also provide sufficient visual representations of the dynamic properties of the system, such as speed, oscillation and the duration of the process. Thus, to analyze and verify system performance, the rotary pulser was tested with various types of control signals.

Figure 22:
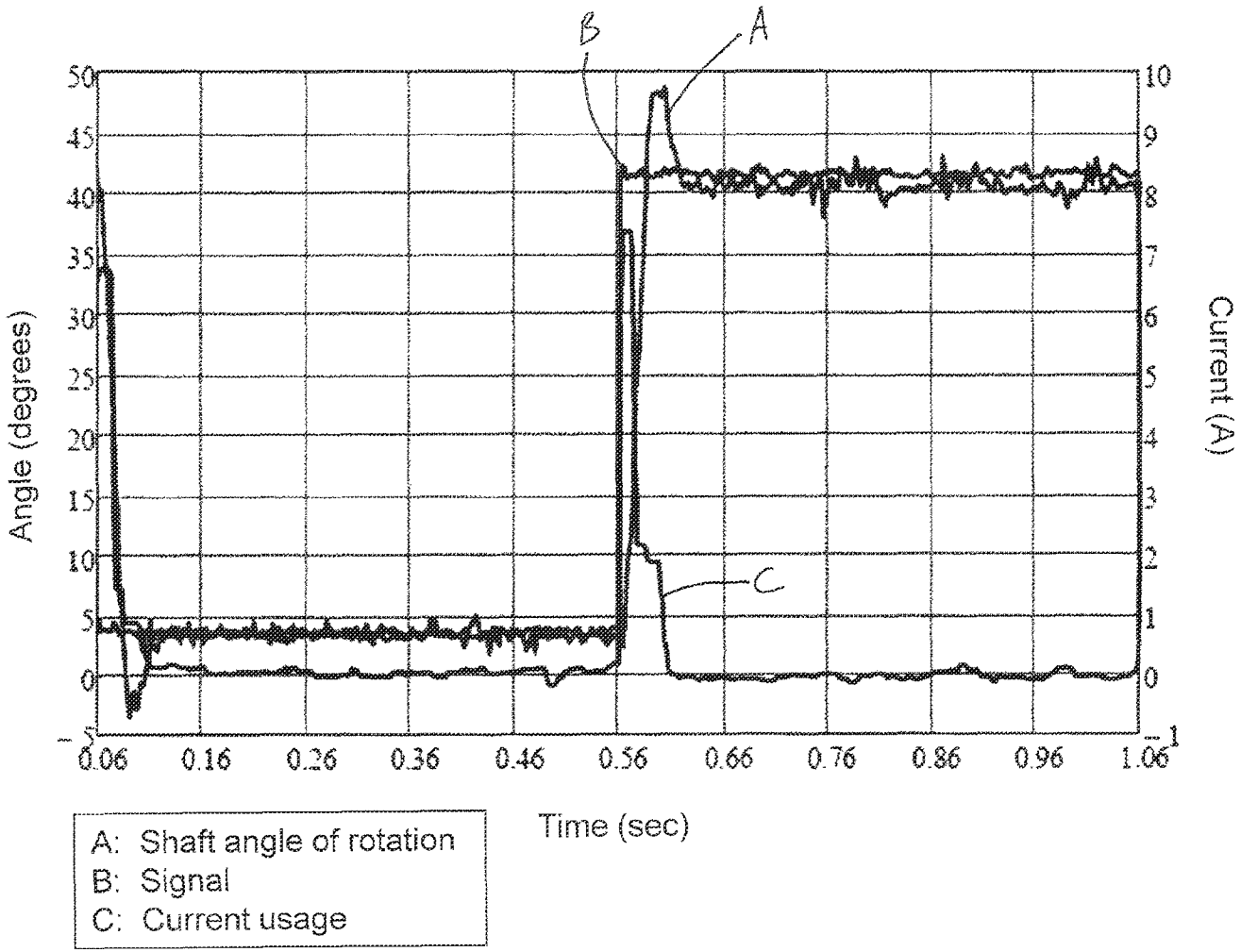
FIG. 22 is a graph illustrating a shaft angle, a rectangular signal form, and a current for testing of an exemplary rotary pulser.

In particular, FIG. 22 shows a graph for testing the prototype at a stepped rectangular signal form with a frequency of approximately 1 Hz, a period of approximately 1 second, and a minimum amount of energy of approximately 8.198 J. The left axis represents the angle in degrees of the rotation of the shaft, while the right axis represents the amount of used current in amperes. Curve A represents the response of the system as the system fulfills the operation input signal and provides the estimated performance, dynamic error and oscillation. Curve B represents the transient form of the system with a step input signal. Curve C represents the power consumption (e.g., current usage) of the system for the input signal. The graph shows the angle of the shaft change from approximately 5 degrees to approximately 40 degrees at 0.56 seconds. The signal generally follows the curve of the angle of the shaft. In particular, when the angle of the shaft increases, the signal increases. The current increases from approximately 0 A to approximately 7.3 A at 0.56 seconds when the shaft angle is changed, and further drops to approximately 0 A at 0.6 seconds.

Figure 23:
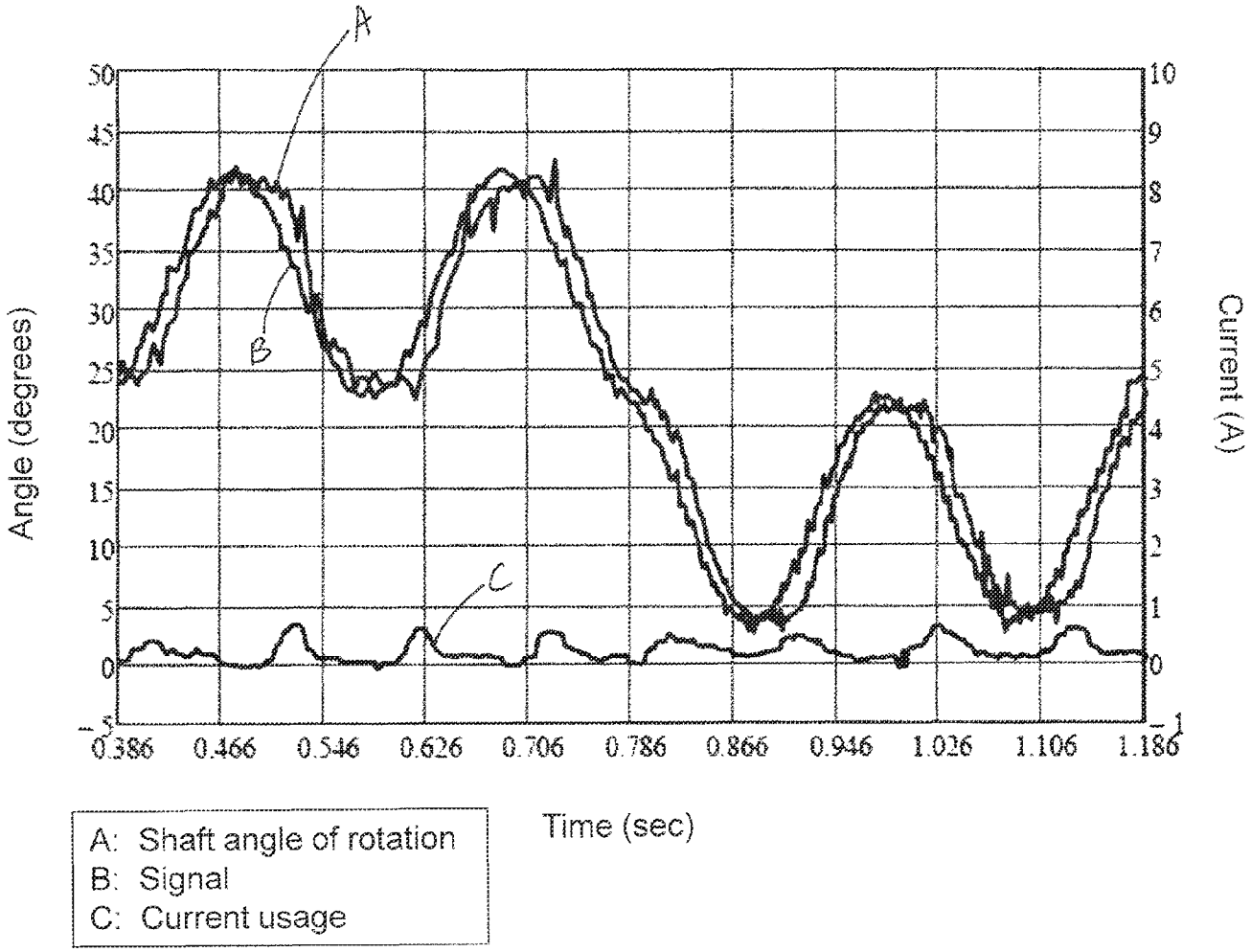
FIG. 23 is a graph illustrating a shaft angle, a harmonic signal form, and a current for testing of an exemplary rotary pulser.

FIG. 23 shows a graph for testing the prototype at a harmonic signal form with a frequency of approximately 1.25 Hz, a sinusoidal signal having an amplitude of 10 degrees and a frequency of 5 Hz, a period of approximately 0.8 seconds, and minimum amount of energy of approximately 4.684 J. In particular, a harmonic disturbance was imposed on the signal. Curve B represents the harmonic input signal frequency of approximately 1.25 Hz overlaid with the harmonic disturbance frequency of approximately 5 Hz. Curve A represents the response of the system. Curve C represents the power consumption (e.g., current usage) of the system for the input signal. The graph shows the angle of the shaft change and the signal following a similar sinusoidal curve during each period. The current also follows a substantially sinusoidal curve fluctuating between approximately 0 A and approximately 0.5 A.

Figure 24:
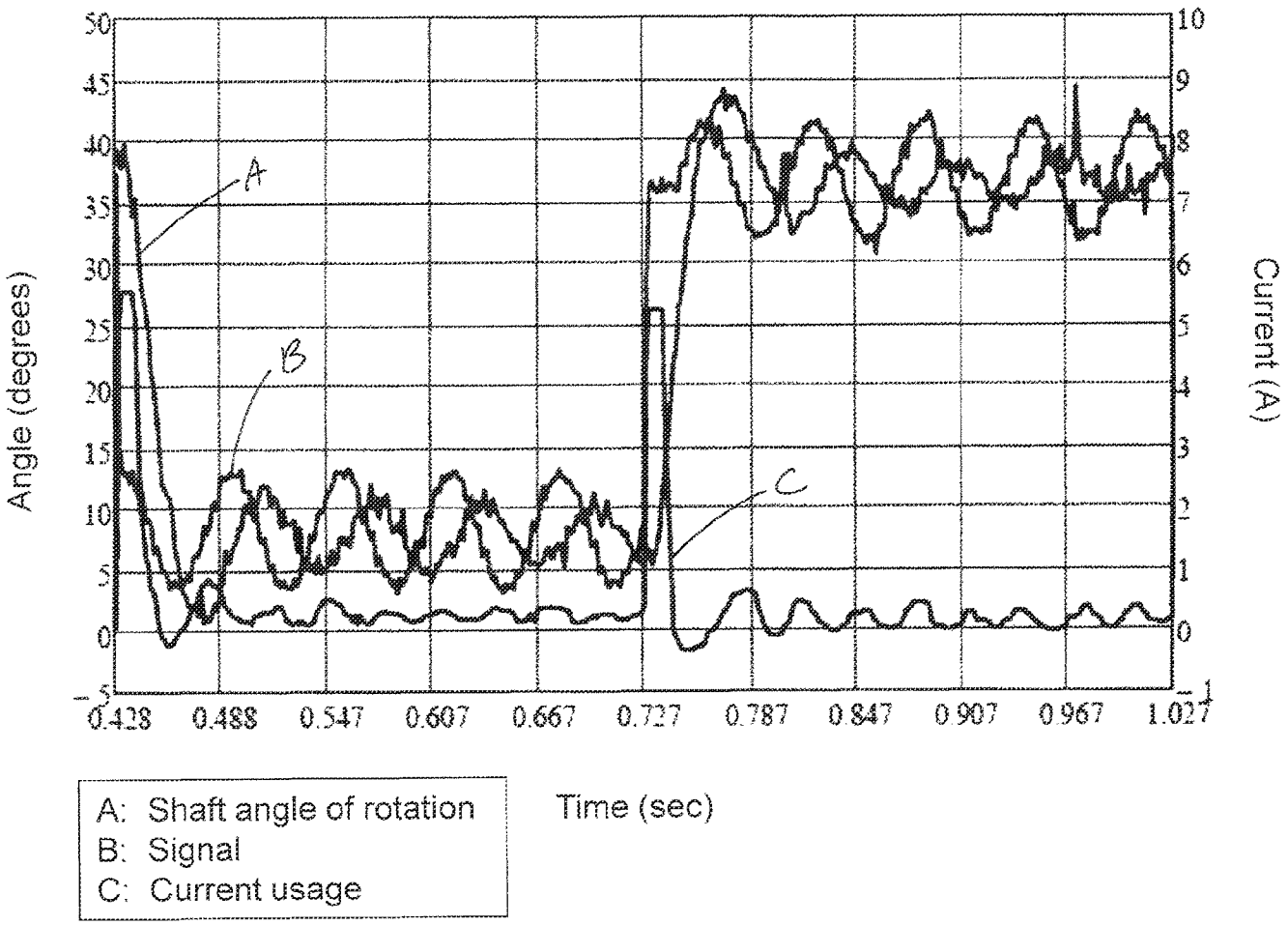
FIG. 24 is a graph illustrating a shaft angle, a rectangular inlet signal form with a harmonic disturbance, and a current for testing of an exemplary rotary pulser.

FIG. 24 shows a graph for testing the prototype at a stepped rectangular input signal form imposed on a harmonic disturbance, the stepped input signal having a frequency of approximately 1.667 Hz, a sinusoidal signal having an amplitude of 5 degrees and a frequency of 16 Hz, a period of approximately 0.6 seconds, and a minimum amount of energy of approximately 6.914 J. Curve B represents the input step signal with the imposed harmonic disturbance. Curve A represents the response of the system. Curve C represents the power consumption (e.g., current usage) of the system for the input signal. The graph shows the angle of the shaft and the signal following a similar sinusoidal curve during each period in an offset manner. The current also follows a substantially sinusoidal curve fluctuating between approximately 0 A and approximately 0.7 A, with a maximum of approximately 5.2 A during generation of a pulse.

Figure 25:
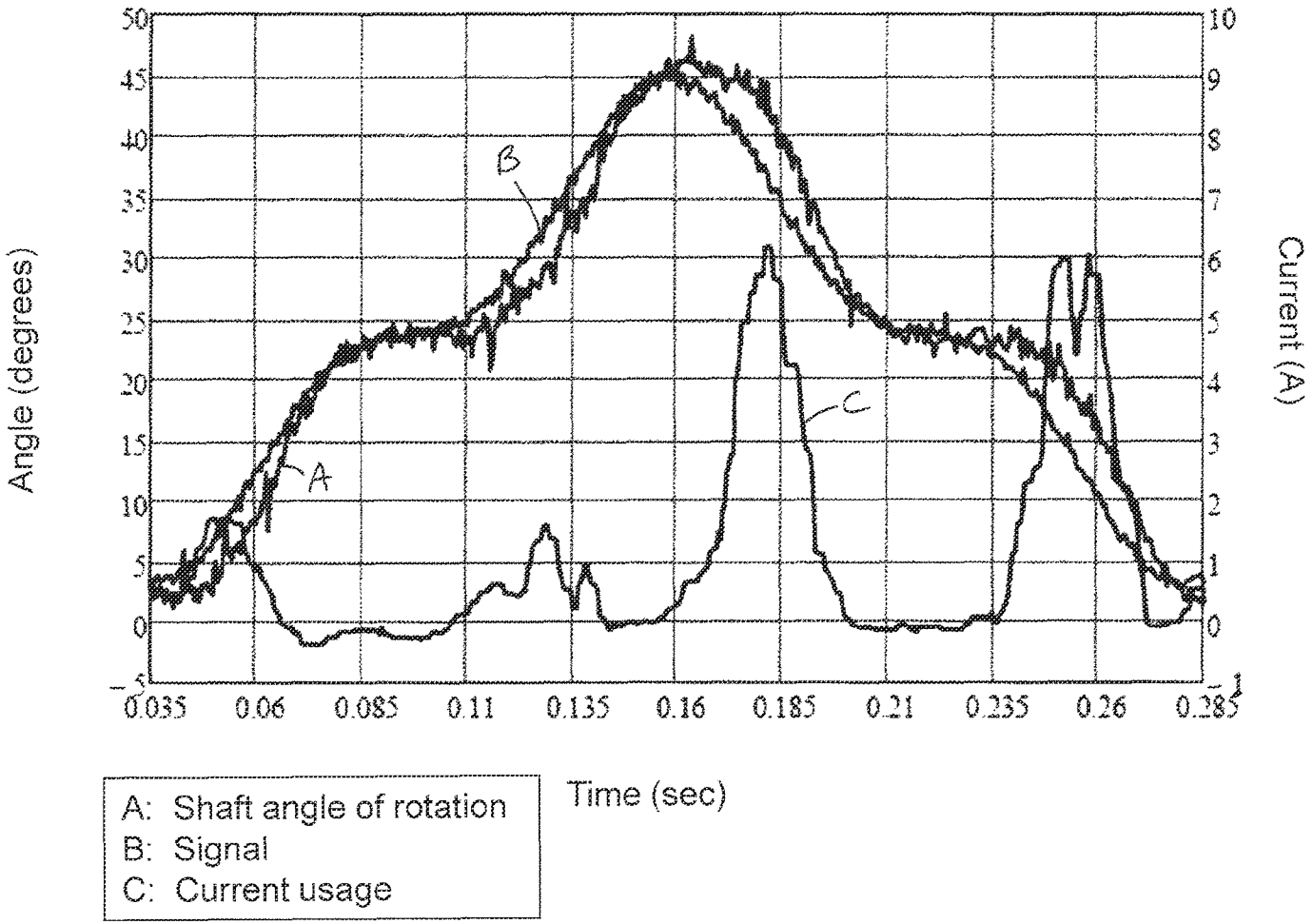
FIG. 25 is a graph illustrating a shaft angle, a signal, and a current for testing of an exemplary rotary pulser.

FIG. 25 shows a graph for testing the prototype at a harmonic input signal overlaid with a disturbance different from the process performance of FIG. 23, the input signal having a frequency of approximately 4 Hz, fluctuations of 5 degrees in amplitude and a frequency of 12 Hz, a period of approximately 0.25 seconds, and a minimum amount of energy of approximately 7.538 J. Curve B represents the input harmonic signal with a frequency of approximately 4 Hz and a disturbance with a frequency of approximately 12 Hz. Curve A represents the response of the system. Curve C represents the power consumption (e.g., current usage) of the system for the input signal. The graph shows the angle of the shaft and the signal follow a similar curve during each period. The current reaches a maximum of approximately 6.2 A, while the mean current is approximately 1.8 A.

Figure 26:
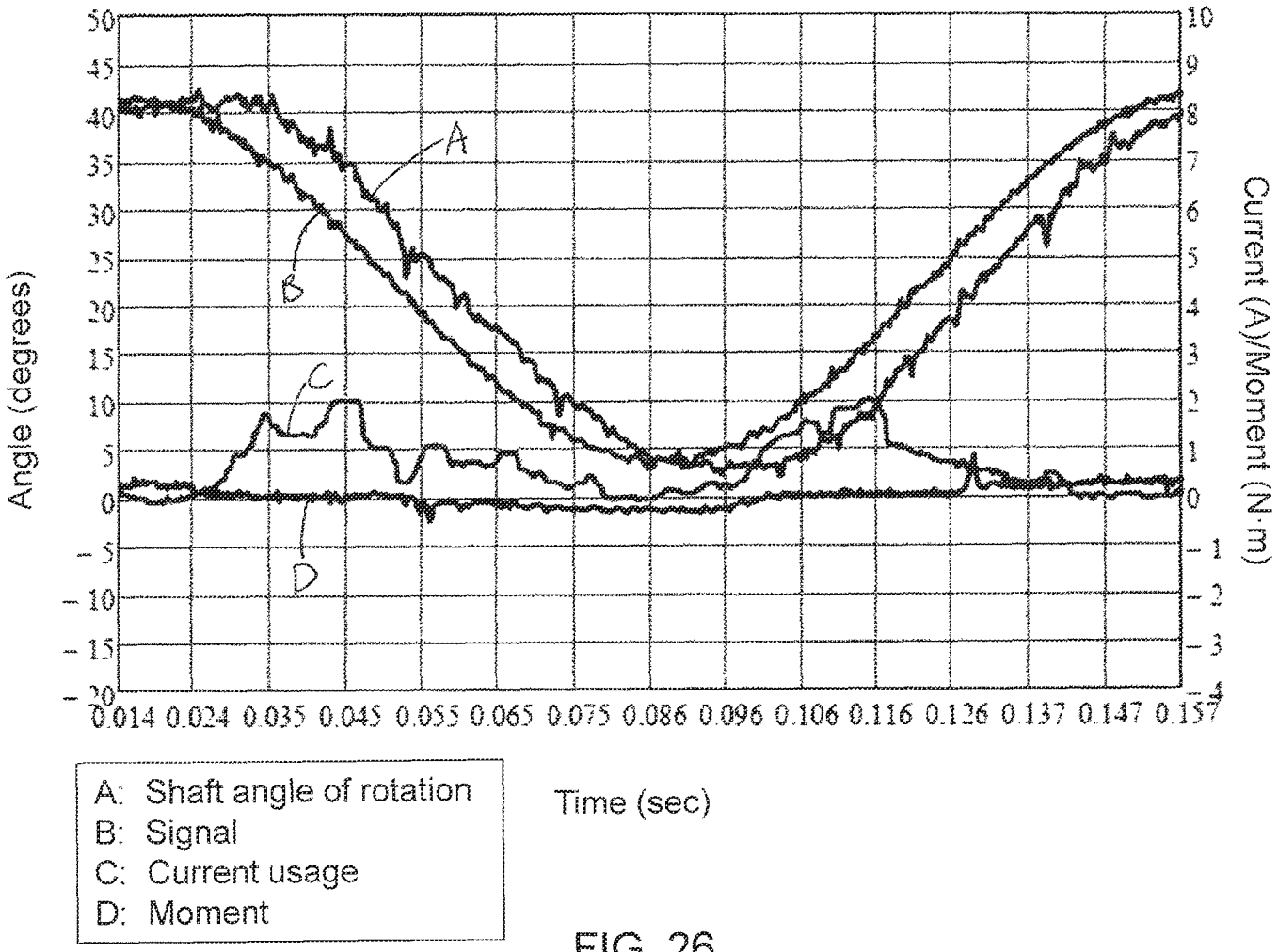
FIG. 26 is a graph illustrating a shaft angle, a signal, a moment, and a current for testing of an exemplary rotary pulser.

FIG. 26 shows a graph for testing the prototype at a gain coefficient of sin(30), a load of 7 Hz, a harmonic signal frequency of approximately 7 Hz, a period of approximately 0.143 seconds, and a minimum amount of energy of approximately 2.659 J. In particular, the testing was intended to assess the dynamic properties of the system for overcoming a load of approximately 0.487 N·m. Curve B represents the input signal with a harmonic frequency of approximately 7 Hz. Curve A represents the response of the system to the harmonic input signal. Curve C represents the power consumption (e.g., current usage) of the system for the input signal. Curve D represents the torque or moment for overcoming the load on the system. The minimum moment load is shown as approximately −0.487 N·m (i.e., approximately −4.312 $lb_f$·in).

Figure 27:
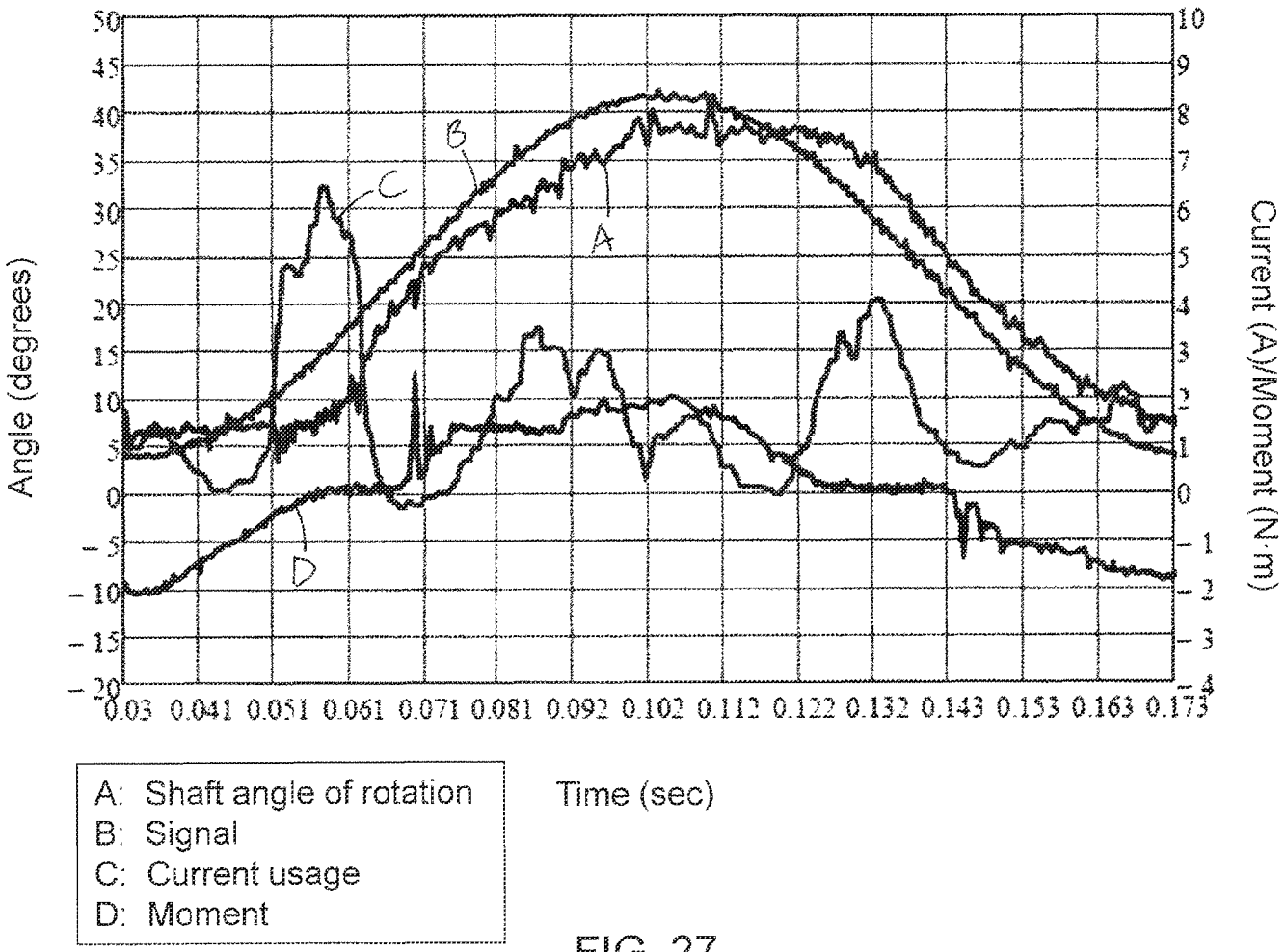
FIG. 27 is a graph illustrating a shaft angle, a signal, a moment, and a current for testing of an exemplary rotary pulser.

FIG. 27 shows a graph for testing the prototype at a gain coefficient of sin(50), a load of 7 Hz, a harmonic input signal frequency of approximately 7 Hz, a period of approximately 0.143 seconds, and a minimum amount of energy of approximately 6.631 J. Curve B represents the harmonic input signal including an input load to be overcome by the system. Curve D represents the torque or moment for overcoming the load of approximately 2.545 N·m on the system. Curve A represents the response of the system to the harmonic input signal. Curve C represents the power consumption (e.g., current usage) of the system for the input signal. The minimum moment load is shown as approximately 2.545 N·m (i.e., approximately 22.525 $lb_f$·in).

Testing of the prototype therefore investigated and analyzed the properties and dynamic characteristics of the rotary pulser system (based on the generated output signals) in the time domain for different types of input signals. From the results, a determination can be made of the current consumption of the system. In general, manufacturers of power sources have limits for current consumption of the power sources. For example, electrical batteries used in the industry generally have a current consumption limit of approximately 5 A. The current consumption restriction leads to an artificial reduction in the speed of the system created by the rotary pulser when used with electric battery power. Therefore, a generator, or the like, is typically used as an energy source with a higher value of current output than the limits imposed by battery power. In contrast, the exemplary rotary pulser system provides modulation of the signal such that different sources of electrical energy, such as batteries of different manufacturers, generators of different manufacturers, or the like, can be used while removing the restriction on the speed of the system typically caused by current consumption. As such, the system can be used with different types of power sources without incurring the current and/or speed limitations typically seen in the industry. In addition, the system allows the variation and adjustment of the generated signal, including the amplitude, frequency and type (e.g., sine, logic, or the like), creating a different set of harmonics and their sequence. Thus, the system results in an electric power generator than allows for signal transfer speeds of up to approximately 5 bits per second.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A rotary pulser for a downhole telemetry system configured to be positioned in a drill string within a wellbore, the rotary pulser configured to generate pressure pulses in a drilling fluid, the rotary pulser comprising:

a housing, a stator disposed within the housing, a rotor disposed adjacent to the stator within the housing, and an electrohydraulic drive disposed within the housing for rotating the rotor relative to the stator, the electrohydraulic drive comprising:

a pump with a regulator mechanism, an actuation mechanism, an electric motor, and a control unit, wherein, based on a parameter or condition associated with the rotary pulser, the regulator mechanism adjusts a parameter of the pump to control rotation of the rotor; and wherein the actuation mechanism comprises a cylinder block, a valve disposed within the cylinder block, pistons and a cam, the cam defines ramp profiles including rolling surfaces along which piston heads of the pistons move, and the ramp profiles of the cam impart varying degrees of forces on the piston heads as the pistons move along the rolling surfaces.

2. The rotary pulser according to claim 1, wherein, based on the parameter or condition associated with the rotary pulser, the regulator mechanism automatically adjusts the parameter of the pump to control the rotation of the rotor.

3. The rotary pulser according to claim 1, comprising a stepper motor mechanically coupled to linkages, wherein the linkages are mechanically coupled to a disc.

4. The rotary pulser according to claim 3, wherein, based on the parameter or condition associated with the rotary pulser, the regulator mechanism regulates a tilt angle of the disc with the linkages to adjust the parameter of the pump to control the rotation of the rotor.

5. The rotary pulser according to claim 1, wherein the pump comprises a disc adapted to be tilted to vary a tilt angle of the disc.

6. The rotary pulser according to claim 5, wherein varying the tilt angle of the disc adjusts the parameter of the pump to control the rotation of the rotor.

7. The rotary pulser according to claim 5, comprising pistons secured at one end to a top surface of the disc and secured at an opposing end to the pump.

8. The rotary pulser according to claim 7, wherein varying the tilt angle of the disc actuates the pistons to adjust the parameter of the pump to control the rotation of the rotor.

9. The rotary pulser according to claim 7, wherein the pistons are circumferentially secured to the top surface of the disc relative to a central vertical axis of the disc.

10. The rotary pulser according to claim 5, wherein the disc comprises a flat top surface and a convex bottom surface.

11. The rotary pulser according to claim 10, wherein the disc comprises a flange extending across the convex bottom surface, the flange comprising a pair of hinges configured for coupling to linkages of the regulator mechanism.

12. The rotary pulser according to claim 1, comprising a sensor for sensing the parameter or condition associated with the rotary pulser and communicatively linked to the regulator mechanism.

13. The rotary pulser according to claim 12, wherein, based on a signal transmitted by the sensor to the regulator mechanism regarding a measured change in the parameter or condition associated with the rotary pulser, the regulator mechanism adjusts the parameter of the pump to control rotation of the rotor.

14. The rotary pulser according to claim 1, wherein adjustment of the parameter of the pump with the regulator mechanism adjusts rotation of the cylinder block which, in turn, adjusts the rotation of the rotor.

15. The rotary pulser according to claim 1, wherein the actuation mechanism comprises a flow channel extending from the pump to the valve.

16. The rotary pulser according to claim 1, wherein the actuation mechanism comprises a first drain channel extending from the valve, through the cylinder block and into a second drain channel formed in the rotary pulser.

17. The rotary pulser according to claim 1, wherein the cylinder block comprises four channels radially formed in the cylinder block, the four channels connecting the valve to the pistons.

18. The rotary pulser according to claim 1, wherein the parameter or condition of the rotary pulser comprises at least one of (i) a load imparted on the rotor due to pressure of working fluid around the rotary pulser, (ii) a load imparted on the rotor due to pressure of working fluid within the rotary pulser, or (iii) a fluid pressure in a drain or discharge channel of the rotary pulser.

19. The rotary pulser according to claim 1, wherein the parameter of the pump is a gear ratio of the pump.

20. The rotary pulser according to claim 1, wherein the regulator mechanism is mechanically connected to the pump.

21. The rotary pulser according to claim 1, wherein adjusting the parameter of the pump to control rotation of the rotor changes at least one of a frequency or an amplitude of a pulse signal generated by the rotary pulser.

22. The rotary pulser according to claim 1, comprising a distribution unit, an energy storage unit, a pump assembly including the pump and the regulator mechanism, and an electromechanical unit, wherein the distribution unit, the energy storage unit, the pump assembly, and the electromechanical unit are modular and independent units configured to be rearranged relative to each other.

23. A method of regulating a rotary pulser for a downhole telemetry system configured to be positioned in a drill string within a wellbore, the rotary pulser configured to generate pressure pulses in a drilling fluid, the method comprising:

providing a rotary pulser, the rotary pulser including (i) a housing, (ii) a stator disposed within the housing, (iii) a rotor disposed adjacent to the stator within the housing, and (iv) an electrohydraulic drive disposed within the housing for rotating the rotor relative to the stator, the electrohydraulic drive including (a) a pump with a regulator mechanism, (b) an actuation mechanism, (c) an electric motor, and (d) a control unit, and based on a parameter or condition associated with the rotary pulser, adjusting a parameter of the pump with the regulator mechanism to control rotation of the rotor, wherein the actuation mechanism of the rotary pulser comprises a cylinder block, a valve disposed within the cylinder block, pistons and a cam, the cam defines ramp profiles including rolling surfaces along which piston heads of the pistons move, and the ramp profiles of the cam impart varying degrees of forces on the piston heads as the pistons move along the rolling surfaces.

24. The method according to claim 23, comprising sensing a change in the parameter or condition associated with the rotary pulser with a sensor communicatively linked to the regulator mechanism.

25. The method according to claim 23, comprising adjusting a rotation of a cylinder block of the actuation mechanism based on the adjusted parameter of the pump to control the rotation of the rotor.

26. A rotary pulser for a downhole telemetry system configured to be positioned in a drill string within a wellbore, the rotary pulser configured to generate pulses in a drilling fluid, the rotary pulser comprising:

a housing, a stator disposed within the housing, a rotor disposed adjacent to the stator within the housing, and an electrohydraulic drive disposed within the housing for rotating the rotor relative to the stator, the electrohydraulic drive comprising:

a pump with a regulator mechanism, an actuation mechanism including a cam and pistons, an electric motor, and a control unit, wherein the rotor, the regulator mechanism, the pump and the actuation mechanism are mechanically connected relative to each other, wherein, based on a parameter or condition associated with the rotary pulser, the regulator mechanism adjusts a parameter of the pump to control rotation of the rotor, and wherein the cam defines ramp profiles including rolling surfaces along which piston heads of the pistons move, the ramp profiles of the cam imparting varying degrees of forces on the piston heads as the pistons move along the rolling surfaces.

27. A rotary pulser for a downhole telemetry system configured to be positioned in a drill string within a wellbore, the rotary pulser configured to generate pressure pulses in a drilling fluid, the rotary pulser comprising:

a housing, a stator disposed within the housing, a rotor disposed adjacent to the stator within the housing, and an electrohydraulic drive disposed within the housing for rotating the rotor relative to the stator, the electrohydraulic drive comprising:

a pump with a regulator mechanism, an electric motor, an actuation mechanism comprising a shaft mechanically coupled to the rotor and rotatably disposed within the actuation mechanism, the shaft including a rotary piston extending therefrom, the actuation mechanism further comprising a retainer mechanism for rotatably mounting the shaft within the actuation mechanism, and a control unit, wherein, based on a parameter or condition associated with the rotary pulser, the regulator mechanism adjusts a parameter of the pump to control rotation of the rotor; and wherein the retainer mechanism comprises sectors disposed on opposing sides of a shaft housing, the sectors limiting rotation of the shaft within the shaft housing.

28. The rotary pulser according to claim 27, wherein, based on the parameter or condition associated with the rotary pulser, the regulator mechanism automatically adjusts the parameter of the pump to control the rotation of the rotor.

29. The rotary pulser according to claim 27, comprising a stepper motor mechanically coupled to linkages, wherein the linkages are mechanically coupled to a disc.

30. The rotary pulser according to claim 27, wherein, based on the parameter or condition associated with the rotary pulser, the regulator mechanism regulates a tilt angle of the disc with the linkages to adjust the parameter of the pump to control the rotation of the rotor.

31. The rotary pulser according to claim 27, wherein the pump comprises a disc adapted to be tilted to vary a tilt angle of the disc.

32. The rotary pulser according to claim 31, wherein varying the tilt angle of the disc adjusts the parameter of the pump to control the rotation of the rotor.

33. The rotary pulser according to claim 27, comprising a sensor for sensing the parameter or condition associated with the rotary pulser and communicatively linked to the regulator mechanism.

34. The rotary pulser according to claim 33, wherein, based on a signal transmitted by the sensor to the regulator mechanism regarding a measured change in the parameter or condition associated with the rotary pulser, the regulator mechanism adjusts the parameter of the pump to control rotation of the rotor.

35. The rotary pulser according to claim 27, wherein the parameter or condition of the rotary pulser comprises at least one of (i) a load imparted on the rotor due to pressure of working fluid around the rotary pulser, (ii) a load imparted on the rotor due to pressure of working fluid within the rotary pulser, or (iii) a fluid pressure in a drain or discharge channel of the rotary pulser.

36. The rotary pulser according to claim 27, wherein the parameter of the pump is a gear ratio of the pump.

37. The rotary pulser according to claim 27, wherein the regulator mechanism is mechanically connected to the pump.

38. The rotary pulser according to claim 27, wherein adjusting the parameter of the pump to control rotation of the rotor changes at least one of a frequency or an amplitude of a pulse signal generated by the rotary pulser.

39. The rotary pulser according to claim 27, comprising a distribution unit, an energy storage unit, a pump assembly including the pump and the regulator mechanism, and an electromechanical unit, wherein the distribution unit, the energy storage unit, the pump assembly, and the electromechanical unit are modular and independent units configured to be rearranged relative to each other.

40. A method of regulating a rotary pulser for a downhole telemetry system configured to be positioned in a drill string within a wellbore, the rotary pulser configured to generate pressure pulses in a drilling fluid, the method comprising:

providing a rotary pulser, the rotary pulser including (i) a housing, (ii) a stator disposed within the housing, (iii) a rotor disposed adjacent to the stator within the housing, and (iv) an electrohydraulic drive disposed within the housing for rotating the rotor relative to the stator, the electrohydraulic drive including (a) a pump with a regulator mechanism, (b) an electric motor, (c) an actuation mechanism comprising a shaft mechanically coupled to the rotor and rotatably disposed within the actuation mechanism, the shaft including a rotary piston extending therefrom, the actuation mechanism further comprising a retainer mechanism for rotatably mounting the shaft within the actuation mechanism, and (d) a control unit, and based on a parameter or condition associated with the rotary pulser, adjusting a parameter of the pump with the regulator mechanism to control rotation of the rotor, wherein the retainer mechanism comprises sectors disposed on opposing sides of a shaft housing, the sectors limiting rotation of the shaft within the shaft housing.

41. The method according to claim 40, comprising sensing a change in the parameter or condition associated with the rotary pulser with a sensor communicatively linked to the regulator mechanism.

42. The method according to claim 40, comprising adjusting a rotation of the shaft of the actuation mechanism based on the adjusted parameter of the pump to control the rotation of the rotor.

* * * * *